US010565945B2

(12) United States Patent
Ito et al.

(10) Patent No.: US 10,565,945 B2
(45) Date of Patent: Feb. 18, 2020

(54) DISPLAY DRIVER, DISPLAY CONTROLLER, ELECTRO-OPTICAL DEVICE, AND ELECTRONIC APPARATUS

(71) Applicant: SEIKO EPSON CORPORATION, Tokyo (JP)

(72) Inventors: Akihiko Ito, Tatsuno-machi (JP); Masahiko Miura, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/034,976

(22) Filed: Jul. 13, 2018

(65) Prior Publication Data

US 2019/0035342 A1 Jan. 31, 2019

(30) Foreign Application Priority Data

Jul. 31, 2017 (JP) ..... 2017-148106

(51) Int. Cl.
*G09G 3/36* (2006.01)

(52) U.S. Cl.
CPC ..... *G09G 3/3607* (2013.01); *G09G 2310/027* (2013.01); *G09G 2310/08* (2013.01); *G09G 2320/0247* (2013.01); *G09G 2320/041* (2013.01); *G09G 2320/0673* (2013.01)

(58) Field of Classification Search
CPC ..... G09G 2320/041; G09G 2310/08; G09G 2320/0673
See application file for complete search history.

(56) References Cited

U.S. PATENT DOCUMENTS

2004/0196234 A1* 10/2004 Shiomi ..... G09G 3/3648 345/89
2004/0252111 A1* 12/2004 Cheon ..... G09G 3/20 345/204
2005/0007392 A1* 1/2005 Kasai ..... G09G 3/2014 345/690
2008/0117228 A1* 5/2008 Lee ..... G09G 3/20 345/602
2012/0050280 A1* 3/2012 Kim ..... G09G 3/003 345/419
2015/0269901 A1* 9/2015 Kobayashi ..... G09G 3/3696 345/212

FOREIGN PATENT DOCUMENTS

JP 2009-294265 A 12/2009
JP 2015-176120 A 10/2015

* cited by examiner

*Primary Examiner* — Dong Hui Liang
(74) *Attorney, Agent, or Firm* — Oliff PLC

(57) ABSTRACT

A display driver includes a processing circuit to which information regarding a temperature range is input and that performs gamma conversion processing on display data with respect to gray level. In the gamma conversion processing, at a first set point, a first output gray level is gray level m when the temperature range is a first temperature range, and is gray level n (m and n are integers of zero or more and are different to each other) when the temperature range is a second temperature range, and the processing circuit changes, when the temperature range has transitioned from the first temperature range to the second temperature range, the first output gray level from gray level m to gray level n by a step smaller than |n−m|.

12 Claims, 16 Drawing Sheets

| TONE | TONE VOLTAGE |
|---|---|
| 0 | $V_0$ |
| 1 | $V_1$ |
| 2 | $V_2$ |
| 3 | $V_3$ |
| ⋮ | ⋮ |
| 255 | $V_{255}$ |

FIG. 3

| SET POINT | INPUT TONE | OUTPUT TONE |
|---|---|---|
| 1 | 0 | 0 |
| 2 | 8 | 9 |
| 3 | 16 | 17 |
| 4 | 32 | 30 |
| 5 | 48 | 43 |
| 6 | 64 | 54 |
| 7 | 80 | 65 |
| 8 | 96 | 74 |
| 9 | 128 | 98 |
| 10 | 160 | 123 |
| 11 | 176 | 139 |
| 12 | 192 | 156 |
| 13 | 208 | 176 |
| 14 | 224 | 199 |
| 15 | 240 | 227 |
| 16 | 248 | 240 |
| 17 | 255 | 255 |

FIG. 7

| SET POINT | INPUT TONE | OUTPUT TONE |
|---|---|---|
| 1 | 0 | 0 |
| 2 | 8 | 12 |
| 3 | 16 | 25 |
| 4 | 32 | 46 |
| 5 | 48 | 64 |
| 6 | 64 | 79 |
| 7 | 80 | 94 |
| 8 | 96 | 107 |
| 9 | 128 | 133 |
| 10 | 160 | 160 |
| 11 | 176 | 176 |
| 12 | 192 | 192 |
| 13 | 208 | 208 |
| 14 | 224 | 226 |
| 15 | 240 | 243 |
| 16 | 248 | 250 |
| 17 | 255 | 255 |

FIG. 8

| SET POINT | FIRST TEMPERATURE RANGE | SECOND TEMPERATURE RANGE |
|---|---|---|
| P1 | 8 | 10 |
| P2 | 16 | 18 |
| P3 | 32 | 35 |
| P4 | 48 | 51 |
| P5 | 64 | 68 |
| P6 | 80 | 82 |
| P7 | 96 | 100 |
| P8 | 112 | 117 |
| P9 | 128 | 130 |
| P10 | 144 | 148 |
| P11 | 160 | 162 |
| P12 | 176 | 180 |
| P13 | 192 | 195 |
| P14 | 208 | 211 |
| P15 | 224 | 227 |
| P16 | 240 | 246 |
| P17 | 255 | 255 |

FIG. 10

| | | | | | |
|---|---|---|---|---|---|
| 8 | 8.06 | 8.13 | 8.19 | ... | 10 |
| 16 | 16.06 | 16.13 | 16.19 | ... | 18 |
| 32 | 32.09 | 32.19 | 32.28 | ... | 35 |
| 48 | 48.09 | 48.19 | 48.28 | ... | 51 |
| 64 | 64.13 | 64.25 | 64.38 | ... | 68 |
| 80 | 80.06 | 80.13 | 80.19 | ... | 82 |
| 96 | 96.13 | 96.25 | 96.38 | ... | 100 |
| 112 | 112.16 | 112.31 | 112.47 | ... | 117 |
| 128 | 128.06 | 128.13 | 128.19 | ... | 130 |
| 144 | 144.13 | 144.25 | 144.38 | ... | 148 |
| 160 | 160.06 | 160.13 | 160.19 | ... | 162 |
| 176 | 176.13 | 176.25 | 176.38 | ... | 180 |
| 192 | 192.09 | 192.19 | 192.28 | ... | 195 |
| 208 | 208.09 | 208.19 | 208.28 | ... | 211 |
| 224 | 224.09 | 224.19 | 224.28 | ... | 227 |
| 240 | 240.19 | 240.38 | 240.56 | ... | 246 |
| 255 | 255.00 | 255.00 | 255.00 | ... | 255 |

s0 s1 s2 s3 s32 TIME

FIG. 14

DISPLAY DRIVER, DISPLAY CONTROLLER, ELECTRO-OPTICAL DEVICE, AND ELECTRONIC APPARATUS

BACKGROUND

1. Technical Field

The present invention relates to a display driver, a display controller, an electro-optical device, an electronic apparatus, and the like.

2. Related Art

Nowadays, electro-optical panels such as color liquid-crystal panels are often used in electronic apparatuses such as monitors, TVs, and notebook computers. In color liquid crystal panels, each pixel is constituted by R, G, and B subpixels, for example, and one pixel, as a whole, expresses one color by combining colors of the R, G, and B subpixels. The colors of the R, G, and B subpixels are each determined by the luminance of light that passes through a color filter provided thereon. The luminance of light that passes through each color filter is determined by a voltage supplied to a corresponding source electrode (data line) of the liquid-crystal panel. This voltage is referred to as a gray level voltage. The electronic apparatus is provided with a display driver including a circuit device that drives the liquid-crystal panel by controlling the gray level voltage.

In general, the input (such as an input voltage or an input signal) and the output (such as light transmittance or brightness) in the liquid-crystal panel are not in a linear direct proportional relationship. Each liquid-crystal panel has its own specific gamma characteristic (luminance characteristic) resulting from the liquid-crystal material that is used and variations in manufacturing. Therefore, gray level voltages in which consideration is given to the characteristics of the liquid crystal panel need to be supplied to the source electrodes of the liquid-crystal panel in order to express desired gray levels.

When gamma correction is performed by digital processing, a processing circuit of a display driver (or a processing circuit of a display controller) performs correction processing on display data input from an external device (CPU of an electronic apparatus, for example), and outputs corrected display data to a drive circuit. For example, the processing circuit stores correction data in a memory as a look-up table (hereinafter, referred to as an "LUT"), and performs gamma correction by making reference to the LUT.

The characteristics of a liquid-crystal panel are known to change greatly according to temperature. When there is a large change in temperature, temperature compensation processing for switching data (LUT to be referred to) used for gamma correction needs to be performed. In this case, if there is a large change in output gray level in a short period of time (drive voltage changes a large amount), a change in luminance to a degree that a user can recognize may occur, and therefore it is not preferable.

In JP-A-2009-294265, a method is disclosed in which a plurality of gray level regions are set, and gamma conversion processing is successively performed for each gray level region. Also, in JP-A-2009-294265, a method is disclosed in which gamma conversion processing is performed step by step such that the color difference ΔE is less than or equal to a predetermined value.

In JP-2015-176120, a method is disclosed in which the power supply voltage of drive voltages is increased or decreased step by step.

In the method in JP-A-2009-294265, control so as to perform gamma conversion for each gray level region, or control so as to limit the color difference ΔE due to gamma conversion to be less than or equal to a predetermined value needs to be performed, and a circuit for performing gamma conversion processing becomes complicated. Also, the method in JP-2015-176120 is a method in which analog gamma correction is performed so as to control the drive voltage, and is not a method in which gamma correction is performed through digital processing. Voltages need to be finely controlled, in analog gamma correction, in order to suppress a change in luminance or color (flickering in a screen) when temperature compensation is performed, and therefore the circuit becomes complicated.

SUMMARY

According to some aspects of the invention, a display driver, a display controller, an electro-optical device, an electronic apparatus, and the like can be provided that can suppress a rapid change in luminance or the like due to performing processing to compensate for an environmental change with a simple configuration.

Also, according to some aspects of the invention, a display driver, a display controller, an electro-optical device, an electronic apparatus, and the like can be provided that can suppress a rapid change in luminance or the like due to performing temperature compensation processing.

One aspect of the invention relates to a display driver including a processing circuit to which information regarding a temperature range to which temperature information detected by a temperature sensor is input and that is configured to perform gamma conversion processing on display data with respect to gray level. In the gamma conversion processing, at a first set point at which a first input gray level is associated with a first output gray level, the first output gray level is gray level m when the temperature range is a first temperature range, and the first output gray level is gray level n (m and n are integers of zero or more and are different to each other) when the temperature range is a second temperature range, and the processing circuit is configured to, when the temperature range has transitioned from the first temperature range to the second temperature range, change the first output gray level from the gray level m to the gray level n by a step smaller than $|n-m|$.

In one aspect of the invention, when output gray levels are set for respective temperature ranges in gamma conversion processing, the processing circuit changes the output gray level step by step when the temperature range has transitioned. In this way, a rapid change in output gray level in a short period of time can be suppressed, and as a result, a user recognizing a change in luminance or color as flickering or the like in a screen can be suppressed. Also, the gray level need only be changed over a plurality of steps, and therefore the control for performing temperature compensation and the circuit configuration can be simplified.

Also, in one aspect of the invention, in the gamma conversion processing, at a second set point at which a second input gray level is associated with a second output gray level, the second output gray level is gray level p when the temperature range is the first temperature range, and the first output gray level is gray level q (p and q are integers of zero or more and are different to each other) when the temperature range is the second temperature range, and the processing circuit may, when the temperature range has transitioned from the first temperature range to the second temperature range, change the second output gray level from the gray level p to the gray level q by a step smaller than $|q-p|$.

In this way, the processing circuit can change the output gray levels step by step at a plurality of set points, and a rapid change in output gray level in a short period of time can be suppressed in a wide gray level range.

Also, in one aspect of the invention, the processing circuit may cause the first output gray level to change from the gray level m to the gray level n in a first period after a transition in the temperature range has been detected, and cause the second output gray level to change from the gray level p to gray level q in a second period after the transition in temperature range has been detected, and at least portions of the first period and the second period may overlap.

In this way, the processing circuit parallelly changes output gray levels at different gray levels, and therefore can perform control such that an image that appears less unnatural to a user, compared with a case where output gray levels are successively changed for each gray level range, is displayed.

Also, in one aspect of the invention, at least a gray level of start timings of the first period and the second period and end timings of the first period and the second period may be the same.

In this way, the processing circuit parallelly changes output gray levels at different gray levels, and therefore can perform control such that an image that appears less unnatural to a user, compared with a case where output gray levels are successively changed for each gray level range, is displayed.

Also, in one aspect of the invention, the processing circuit may, when the temperature range has transitioned from the first temperature range to the second temperature range, cause the first output gray level to change from the gray level m to the gray level n by predetermined gray levels per step, and cause the second output gray level to change from the gray level p to the gray level q by the predetermined gray levels per step.

In this way, the processing circuit changes the output gray level by predetermined gray levels, and therefore can realize temperature compensation with easy control.

Also, in one aspect of the invention, the processing circuit may, when the temperature range has transitioned from the first temperature range to the second temperature range, cause the first output gray level to change from the gray level m to the gray level n, in a period corresponding to a predetermined number of steps s (s is an integer of two or more), by $|n-m|/s$ gray levels per step, and cause the second output gray level to change, in the period corresponding to the predetermined number of steps s, by $|q-p|/s$ gray levels per step.

In this way, the processing circuit changes an output gray level over a period corresponding to a predetermined number of steps, and therefore, can perform control such that an image that appears less unnatural to a user is displayed.

Also, in one aspect of the invention, the display driver may further include a register for storing the predetermined gray levels.

In this way, the predetermined gray levels representing the amount of change in output gray level can be appropriately held and the predetermined gray levels can be flexibly changed.

Also, in one aspect of the invention, the display driver may further include a register for storing the predetermined number of steps s.

In this way, the number of steps from the start of the change to end of the change in output gray level can be appropriately held and the number of steps can be flexibly changed.

Also, in one aspect of the invention, the register may store a length of a period corresponding to the one step.

In this way, the parameter relating to a length of a period from the start to end of the change in output gray level can be appropriately held and the parameter can be flexibly changed.

Also, in one aspect of the invention, the display driver may further include a memory for storing correspondence information between first to $k^{th}$ input gray levels (k is an integer of two or more) and first to $k^{th}$ output gray levels at first to $k^{th}$ set points, respectively.

In this way, the memory need only store the correspondence information at each set point, and therefore the memory size can be reduced.

Also, in one aspect of the invention, at an $i^{th}$ set point of third to $k^{th}$ set points (k is an integer of three or more, i is an integer that satisfies $3 \leq i \leq k$) in the gamma conversion processing, an $i^{th}$ input gray level is associated with an $i^{th}$ output gray level, the $i^{th}$ output gray level is gray level x when the temperature range is the first temperature range, and the $i^{th}$ output gray level is gray level y (x and y are integers of zero or more and are different to each other) when the temperature range is the second temperature range, the processing circuit may, in an $i^{th}$ period after the temperature range has transitioned from the first temperature range to the second temperature range, change the $i^{th}$ output gray level from the gray level x to the gray level y by a step smaller than $|y-x|$, and at least portions of the first period, the second period, and the $i^{th}$ period may overlap.

In this way, the processing circuit can perform control such that, over a wider gray level range, flickering or the like in a screen is suppressed, and an image that appears less unnatural to a user is displayed.

Also, one aspect of the invention, the processing circuit may obtain an output gray level associated with an input gray level between the $i^{th}$ set point and an $i+1^{th}$ set point by performing interpolation processing based on the $i^{th}$ output gray level and an $i+1^{th}$ output gray level at the $i+1^{th}$ set point.

In this way, the memory need only store output gray levels associated with set points as the correspondence information, and therefore the memory size can be reduced.

Also, another aspect of the invention relates to a display driver including a first memory for storing correspondence information between an input gray level and a first temperature output gray level; a second memory for storing correspondence information between the input gray level and a second temperature output gray level; and a processing circuit configured to read out the first temperature output gray level from the first memory and output the first temperature output gray level when temperature information detected by a temperature sensor is in a first temperature range, and read out the second temperature output gray level from the second memory and output the second temperature output gray level when the temperature information is in a second temperature range. The processing circuit is configured to, when the temperature information has transitioned from the first temperature range to the second temperature range, after outputting an output gray level between the first temperature output gray level and the second temperature output gray level, output the second temperature output gray level.

In another aspect of the invention, the display driver includes a memory for storing correspondence information for a first temperature range and a memory for storing correspondence information for a second temperature range, and changes the memory from which stored data is to be read out according to the temperature range to which the temperature detected by a temperature sensor belongs. Furthermore, when the gray level is changed from a first temperature output gray level to a second temperature output gray level, the output gray level is changed step by step. In this way, a rapid change in output gray level in a short period of time can be suppressed, and therefore, the user can be kept from recognizing a change in luminance or color as flickering or the like in a screen.

Also, another aspect of the invention relates to a display driver including a processing circuit to which information regarding an environment range to which environmental information detected by an environmental sensor belongs is input, and that is configured to perform gamma conversion processing on display data with respect to gray level. In the gamma conversion processing, at a first set point at which a first input gray level is associated with a first output gray level, the first output gray level is gray level m when the environment range is a first environment range, and the first output gray level is gray level n (m and n are integers of zero or more and are different to each other) when the environment range is a second environment range, and the processing circuit is configured to, when the environment range has transitioned from the first environment range to the second environment range, change the first output gray level from the gray level m to the gray level n by a step smaller than $|n-m|$.

In another aspect of the invention, when output gray levels are set for respective environment ranges in the gamma conversion processing, the processing circuit changes the output gray level step by step when the environment range has transitioned to another range. In this way, because a rapid change in output gray level in a short period of time can be suppressed, the user can be kept from recognizing the change in luminance or color as flickering or the like in a screen. Also, the gray level need only be changed over a plurality of steps, and therefore, the control and the circuit configuration for compensating for the change in characteristics due to an environmental change can be simplified.

Also, in another aspect of the invention, the environmental information is optical information or a temporal information.

In this way, the processing circuit can appropriately perform processing for compensating for a change in characteristics due to time elapsing and an environmental change such as a change in the amount of light (brightness) in a surrounding area.

Also, yet another aspect of the invention relates to a display controller including a processing circuit to which information regarding a temperature range to which temperature information detected by a temperature sensor belongs is input, and that is configured to perform gamma conversion processing on display data with respect to gray level. In the gamma conversion processing, at a first set point at which a first input gray level is associated with a first output gray level, the first output gray level is gray level m when the temperature range is a first temperature range, and the first output gray level is gray level n (m and n are integers of zero or more and are different to each other) when the temperature range is a second temperature range, and the processing circuit is configured to, when the temperature range has transitioned from the first temperature range to the second temperature range, change the first output gray level from the gray level m to the gray level n by a step smaller than $|n-m|$.

Yet another aspect of the invention relates to an electro-optical device including the display driver according to any of the above descriptions and an electro-optical panel.

Yet another aspect of the invention relates to an electronic apparatus including the display driver according to any of the above descriptions.

Yet another aspect of the invention relates to an electronic apparatus including the display controller according to the above description.

BRIEF DESCRIPTION OF THE DRAWINGS

The invention will be described with reference to the accompanying drawings, wherein like numbers reference like elements.

FIG. 3 is a diagram illustrating correspondence relationship between gray levels and gray level voltages.

FIG. 7 shows an example of output gray levels and gray level ranges at respective set points.

FIG. 8 shows an example of output gray levels and gray level ranges at respective set points.

FIG. 10 shows an example of output gray levels at respective set points in two temperature ranges.

FIG. 14 shows another example of temporal changes in output gray level at respective set points.

DESCRIPTION OF EXEMPLARY EMBODIMENTS

A present embodiment will be described in the following. Note that the embodiment described below are not intended to unduly limit the content of the invention recited in the claims. Also, all of the configurations described in the embodiment are not necessarily essential as solutions provided by the invention.

1. Exemplary System Configuration

Figure 1:
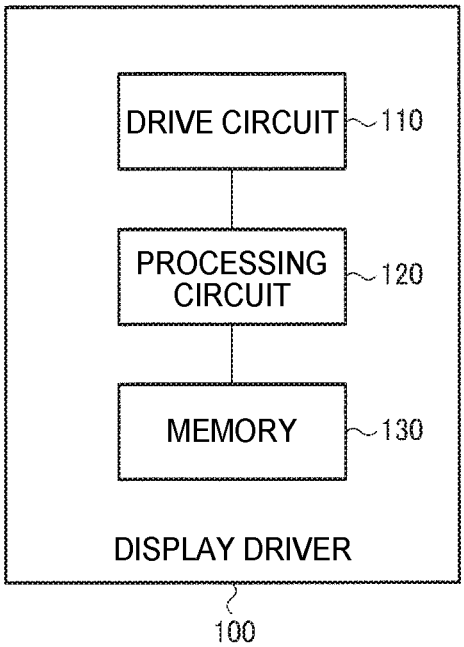
FIG. 1 shows an exemplary configuration of a display driver.

An exemplary configuration of a display driver 100 of the present embodiment is shown in FIG. 1. As shown in FIG. 1, the display driver 100 includes a processing circuit 120 to which information regarding a temperature range to which temperature information detected by a temperature sensor belongs is input, and performs gray level gamma conversion processing on display data (image data). Also, the driver 100 may include a memory 130 that stores information regarding correspondence between an input gray level group and an output gray level group in the gamma conversion processing, and a drive circuit 110 that outputs a drive voltage of a data line based on display data subjected to gamma conversion processing. The display driver 100 is realized by an integrated circuit device (IC) or the like, for example. Note that the circuit device 100 is not limited to the configuration of FIG. 1, and various modifications are possible, such as omitting some of these constituent elements or adding other constituent elements.

Specifically, various configurations of the drive circuit 110 are known, and these configurations can be widely applied in the present embodiment. For example, in a later-described example, a D/A converter 30 of the drive circuit 110 outputs any two voltages out of 64 reference voltages $VR_0$ to $VR_{63}$, and a data line driver 40 divides a reference voltage, and as a result, a drive voltage (gray level voltage) corresponding to one of 256 gray scales is generated. Various modifications such as a configuration in which the D/A converter 30 outputs 256 reference voltages corresponding to 256 gray scales can be implemented.

1. 1 Display Driver

Figure 2:
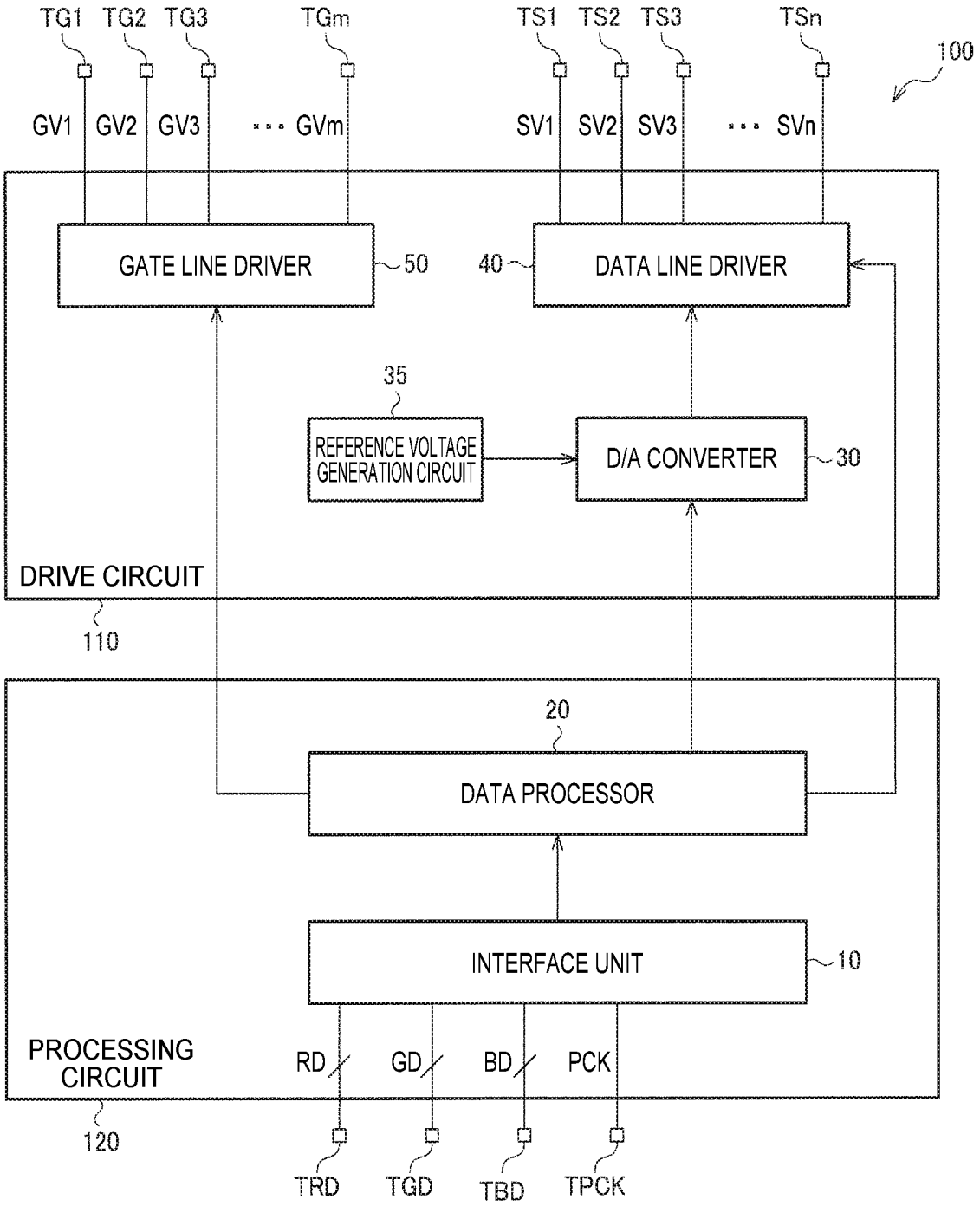
FIG. 2 shows a detailed exemplary configuration of the display driver.

FIG. 2 shows a detailed exemplary configuration of the display driver 100. The drive circuit 110 includes a reference voltage generation circuit 35 (gray level voltage generation circuit), a D/A converter 30 (D/A converter circuit), a data line driver 40 (data line drive circuit), and a gate line driver 50 (gate line drive circuit). The data line driver 40 (data line drive circuit) includes data line drive terminals (data line drive signal output terminals) TS1 to TSn (n is an integer of two or more). Also, the gate line driver 50 (gate line drive circuit) includes gate line drive terminals TG1 to TGm (m is an integer of two or more).

The processing circuit 120 includes an interface unit 10 (interface circuit, terminal) and a data processor 20 (data processing circuit).

The interface unit 10 performs communication with an external processing device. In the case where the display driver 100 is mounted in a car or the like, the processing device, here, is an ECU (Electronic Control Unit). Alternatively, when the display driver 100 is mounted in an electronic apparatus such as an information communication terminal, the processing device is a processor such as a CPU (Central Processing Unit) or a microprocessor.

The interface unit 10 includes a first color component input terminal TRD, a second color component input terminal TGD, a third color component input terminal TBD, and a clock input terminal TPCK. The communication is for transferring display data, supplying a clock signal and a synchronization signal, transferring a command (or a control signal), and the like, for example. Also, the interface unit 10 accepts a terminal setting (input level of a terminal set on a mount substrate). The interface unit 10 is constituted by an I/O buffer or the like, for example.

The data processor 20 performs data processing on display data, timing control, control of units of the display driver 100, and the like, based on display data, a clock signal, a synchronization signal, a command, and the like that are input via the interface unit 10. In the data processing on display data, the data processor 20 performs image processing such as gray level correction processing with reference to the memory 130 (LUT). In the timing control, drive timing (selection timing) of a gate line and a data line in an electro-optical panel is controlled based on the synchronization signal and the display data. The data processor 20 is constituted by a logic circuit such as a gate array, for example.

The reference voltage generation circuit 35 generates a plurality of reference voltages, and outputs the plurality of reference voltages to the D/A converter 30. For example, in a later-described example shown in FIG. 4, a plurality of reference voltages $VR_0$ to $VR_{63}$ are generated. Also, a plurality of gray level voltages are generated based on the reference voltages $VR_0$ to $VR_{63}$. For example, as shown in the table in FIG. 3, generated gray level voltages ($V_0$ to $V_{255}$) respectively correspond to a plurality of gray levels (0 to 255). Also, in the present embodiment, the reference voltages output from the reference voltage generation circuit 35 are used in common when a plurality of pieces of color component display data (first color component display data, second color component display data, third color component display data, and the like, for example) are displayed, and therefore the reference voltage generation circuit 35 need not be provided for each piece of color component display data. In this way, as a result of adopting a configuration in which the plurality of reference voltages are used in common for the first color component display data, the second color component display data, and the third color component display data, the circuit area of the reference voltage generation circuit 35 can be reduced, the layout area of reference voltage lines can be reduced, and as a result, a reduction in the scale of the display driver can be realized. Note that the reference voltage generation circuit 35 may be provided for each color.

The D/A converter 30 D/A-converts display data from the data processor 20 into a reference voltage (data voltage). For example, the D/A converter 30 includes a D/A converter circuit 32 (a plurality of voltage selection circuits) shown in FIG. 4.

The drive circuit 110 drives an electro-optical panel based on first color component display data, second color component display data, and third color component display data, which have been subjected to data processing such as gamma conversion processing, that are obtained from the data processor 20, and the plurality of gray level voltages that are obtained from the reference voltage generation circuit 35. As described above, the plurality of gray level voltages obtained from the reference voltage generation circuit 35 are used in common for the first color component display data, the second color component display data, and the third color component display data.

The data line driver 40 of the drive circuit 110 generates gray level voltages based on the reference voltage from the D/A converter 30. Also, the data line driver 40 outputs the generated gray level voltages respectively to the data line drive terminals TS1 to TSn as the data line drive voltages SV1 to SVn so as to drive data lines of the electro-optical panel. The data line drive voltages SV1 to SVn are voltages that are respectively supplied to the corresponding data line drive terminals TS1 to TSn. The gray level voltages are generated by dividing the reference voltage input from the D/A converter 30 based on the display data subjected to gamma conversion processing that is input from the data processor 20 of the processing circuit 120. Each of the voltages of the data line drive voltages SV1 to SVn is selected from the generated gray level voltages ($V_0$ to $V_{255}$, for example) by the data line driver 40 based on the display data.

Also, the data line driver 40 includes a plurality of data line drive circuits. Each data line drive circuit is provided so as to be associated with one data line drive terminal or a plurality of data line drive terminals. In the case where a data line drive circuit is provided so as to be associated with a plurality of data line drive terminals, the data line drive circuit drives the plurality of data lines in a time division manner.

The gate line driver 50 in the drive circuit 110 outputs gate line drive voltages GV1 to GVm respectively to the gate line drive terminals TG1 to TGm, and drives (selects) gate lines in the electro-optical panel. For example, in an electro-optical panel with a single gate structure, one gate line is selected in one horizontal scanning period. Alternatively, in an electro-optical panel with a dual gate structure or a triple gate structure, two or three gate lines are selected in one horizontal scanning period in a time division manner. The gate line driver 50 is constituted by a plurality of voltage output circuits (buffers, amplifiers), for example, and the voltage output circuits are provided in one-to-one correspondence with the gate line drive terminals.

The memory 130 stores various types of information that is to be used in processing performed by the processing circuit 120. For example, the memory 130 stores correction data (correspondence information) for gamma conversion processing performed by the processing circuit 120. The memory 130 can be realized by a nonvolatile memory such as a PROM (Programmable Read Only Memory). Note that the memory 130 may be a volatile memory such as an SRAM (Static Random Access Memory) or a register.

1. 2 Example of Reference Voltage Generation Circuit and D/A Converter Circuit

Figure 4:
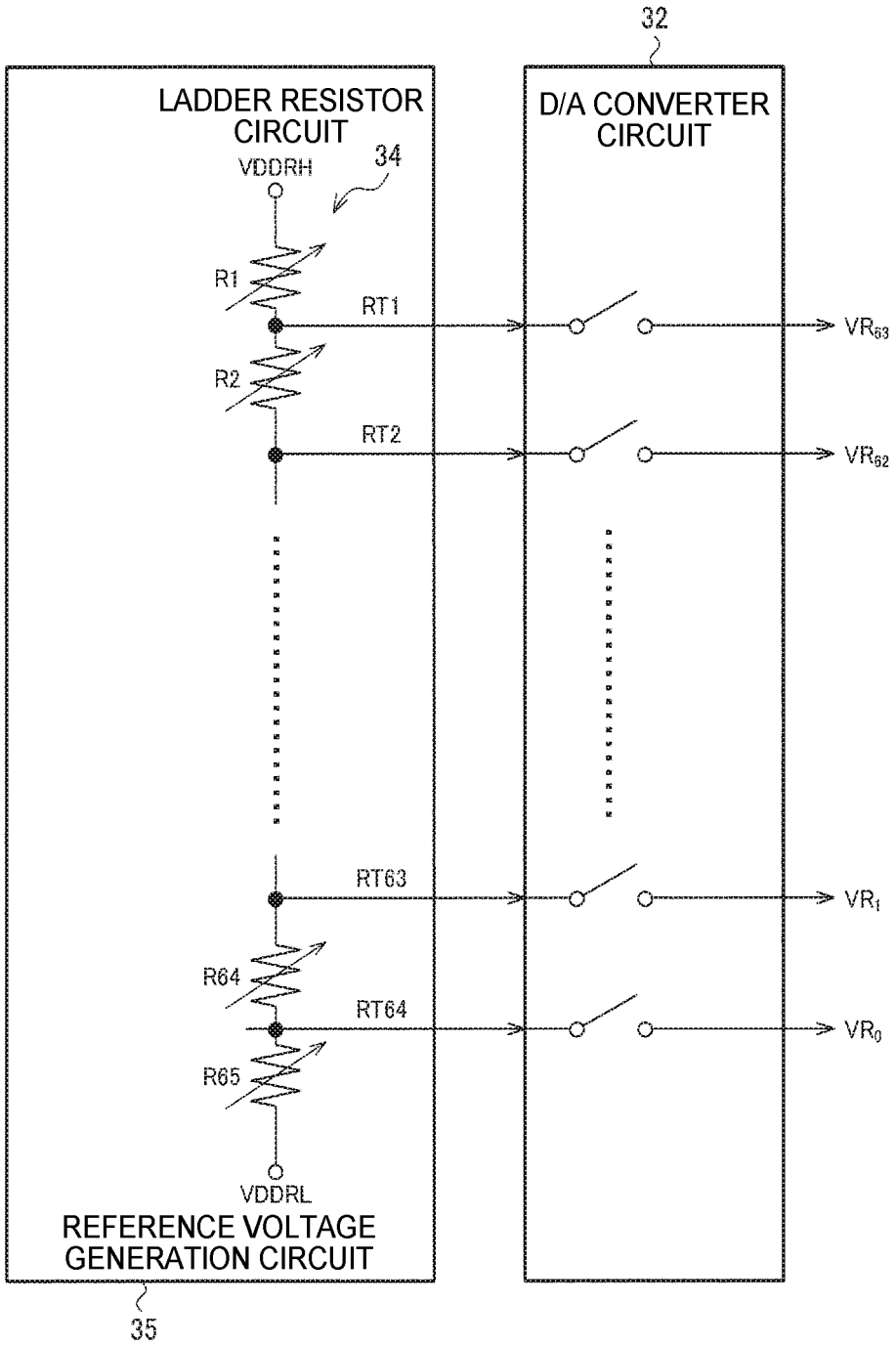
FIG. 4 shows a detailed exemplary configuration of a reference voltage generation circuit and a D/A converter circuit.

FIG. 4 shows an exemplary configuration of the reference voltage generation circuit 35 and the D/A converter circuit 32. The reference voltage generation circuit 35 is constituted by a ladder resistor circuit 34 or the like, and the D/A converter circuit 32 is constituted by switch circuits or the like.

Here, the ladder resistor circuit 34 divides the voltage between a high potential side power supply (power supply voltage) VDDRH and a low potential side power supply (power supply voltage) VDDRL by using resistors with 65 variable resistance circuits (R65 to R1), for example, and outputs a plurality of gray level voltages $VR_0$ to $VR_{63}$ to a respective plurality of resistance division nodes RT64 to RT1. Note that, although a case of 256 gray scales will also be described in the following description, the present embodiment is not limited thereto.

The D/A converter circuit 32 performs ON/OFF control on the switch circuits based on the display data, selects a reference voltage necessary for displaying the display data from the plurality of reference voltages $VR_0$ to $VR_{63}$ that are output from the reference voltage generation circuit 35, and outputs the selected reference voltage to the data line driver 40. Here, as shown in later-described FIG. 5, upper bits of the display data DG are input from the data processor 20, and the D/A converter circuit 32 selects the reference voltage based on the upper bits of the display data DG.

Note that the reference voltage generation circuit and the D/A conversion circuit are not limited to the configuration of FIG. 4, and various modifications are possible. Some of the constituent elements in FIG. 4 may be omitted, or other constituent elements may be added. For example, a positive polarity ladder resistor circuit and a negative polarity ladder resistor circuit may be provided. A circuit (operational amplifier with a voltage follower connection) that performs impedance conversion of the gray level voltage signal may be provided. Alternatively, the reference voltage generation circuit may include a selection voltage generation circuit and a reference voltage selection circuit. In this case, voltages divided by a ladder resistor circuit included in the selection voltage generation circuit are output as a plurality of selection voltages. The reference voltage selection circuit selects 64 (S, in a broad sense) voltages in the case of 256 gray scales, for example, from the selection voltages from the selection voltage generation circuit according to gray level adjustment data, and outputs selected voltages as reference voltages $VR_0$ to $VR_{63}$.

1. 3 Example of Data Line Driver

Figure 5:
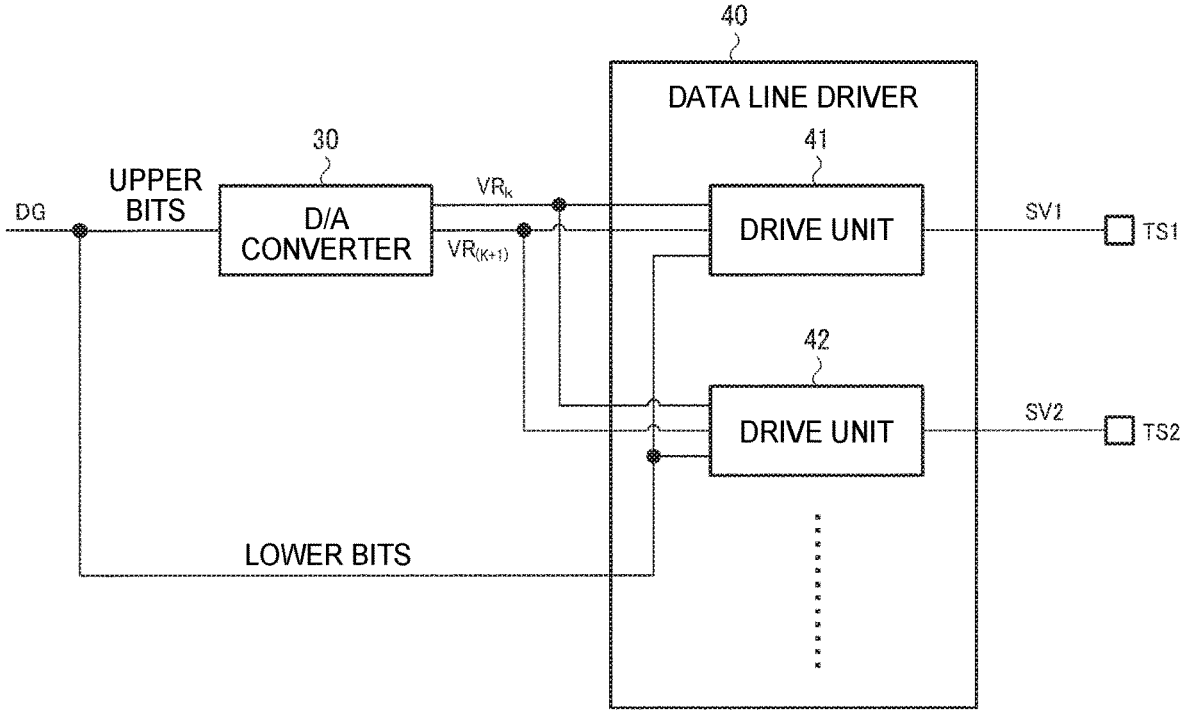
FIG. 5 shows a detailed exemplary configuration of a data line driver.

The generation of the gray level voltages will be described using FIG. 5. Upper bits of the display data DG are input to the D/A converter 30, as described above. The upper-bit data of the display data DG is data for indicating which of the plurality of reference voltages ($VR_0$ to $VR_{63}$) that are generated by the reference voltage generation circuit 35 shown in FIG. 4 are to be used to generate the gray level voltage. In this example, the D/A converter 30 selects at least two reference voltages from the plurality of reference voltages based on the upper bits of the display data DG. For example, when a gray level on a low gray level region side is to be displayed in the electro-optical panel, the D/A converter 30 selects the voltages $VR_0$ and $VR_1$ as the reference voltages, and outputs the selected voltages $VR_0$ and $VR_1$ to the data line driver 40.

Also, the data line driver 40 includes drive units (41, 42, . . . ) for respective data lines. Two reference voltages ($VR_k$ and $VR_{k+l}$) output from the D/A converter 30 and lower bits of the display data DG are input to each drive unit. Each drive unit of the data line driver 40 generates a gray level voltage by performing voltage division using the two reference voltages based on the lower bits of the display data DG, and outputs the generated gray level voltage as a data line drive voltage (SV1 to SVn). Note that the lower bits of the display data DG form data that indicates which gray level voltage will be generated using the two reference voltages input to the data line driver 40.

To give a specific example, gray level voltages $V_0$ to $V_3$, for example, can be generated by performing voltage division using the reference voltages $VR_0$ and $VR_1$ as shown in the following equations (1) to (3).

$$V_0=VR_0 \tag{1}$$

$$V_1=VR_0+(VR_1-VR_0)\times 1/4 \tag{2}$$

$$V_2=VR_0+(VR_1-VR_0)\times 1/2 \tag{3}$$

$$V_3=VR_0+(VR_1-VR_0)\times 3/4 \tag{4}$$

In this example, the above-described lower bits of the display data DG indicate which gray level voltage is to be generated out of the gray level voltages $V_0$ to $V_3$.

2. Temperature Compensation Processing

Next, gamma conversion processing (gamma correction processing) including temperature compensation processing to be performed by the processing circuit 120 will be described in detail with respect to each of a first embodiment, a second embodiment, and modifications.

2. 1 First Embodiment

In gamma conversion processing (internal gamma correction), processing in which variation in the gamma value due to a characteristic (V-T characteristic, relationship between applied voltage and transmittance) of the electro-optical panel is corrected such that the gamma value comes close to a desired value in any of the gray levels, for example. Various types of setting is possible with respect to the desired value of the gamma value, but the desired value is 2.2, for example.

Figure 6:
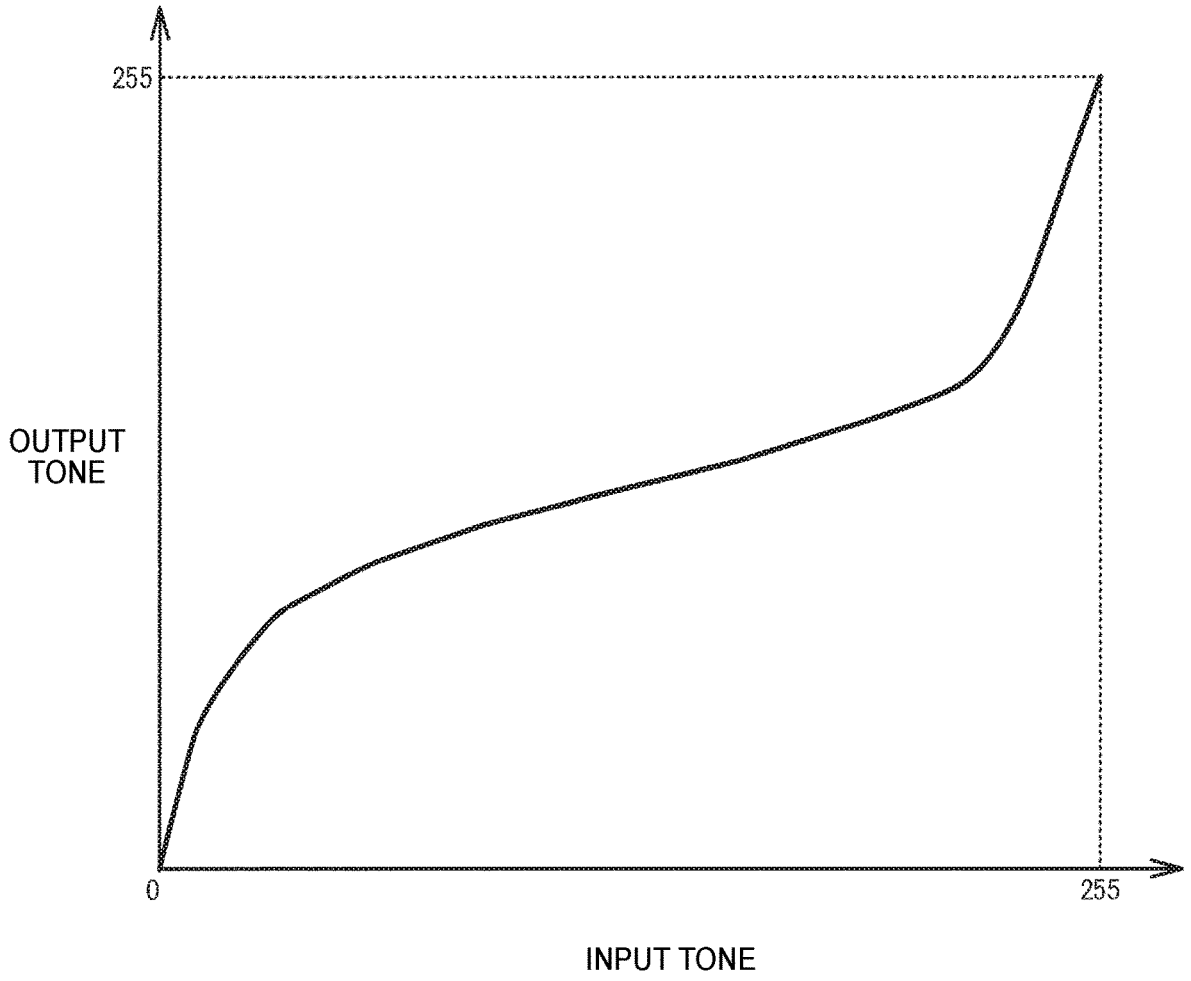
FIG. 6 shows an example of correspondence relationship between input gray levels and output gray levels.

FIG. 6 shows an example of a correspondence relationship between input gray levels and output gray levels, in the gamma conversion processing. The gamma conversion processing is realized by processing in which an input gray level (display data value) is converted to a specific gray level (output gray level) corresponding to the gray level.

The display driver 100 includes the memory 130 that stores correspondence information between first to $k^{th}$ (k is an integer of two or more) input gray levels and first to $k^{th}$ output gray levels at first to $k^{th}$ set points, respectively. Also, the processing circuit 120 obtains the output gray level corresponding to an input gray level between an $i^{th}$ set point and an $i+1^{th}$ set point by performing interpolation processing based on an $i^{th}$ output gray level and an $i+1^{th}$ output gray level.

The set point, here, is a point that indicates an input gray level with respect to which correspondence information is to be stored out of $2^m$ (256, if m=8) input gray levels. For example, in the example shown in later-described FIG. 7, the set points correspond to points such as gray level 0, gray level 8, gray level 16, gray level 32, gray level 48, and the like in the input gray level, and k=17. Also, here, the input gray level at an $i^{th}$ set point is smaller than the input gray level at an $i+1^{th}$ set point. That is, a first set point is on a low gray level region side, and a $k^{th}$ set point is on a high gray level region side. Note that various modifications with respect to the number of set points and the input gray level interval can be implemented.

In this way, the memory 130 need only store correspondence information with respect to a portion of the input gray levels in the range (0 to 255) envisioned as the input gray level. Therefore, the memory size can be reduced compared with a case where the correspondence information is stored with respect to all of the input gray levels. Also, even in a case where a gray level value that is not a set point such as gray level 1 or gray level 2 is input as the display data (input gray level), as a result of performing interpolation processing, the output gray level can be appropriately obtained. The interpolation processing, here, may be linear interpolation (straight-line interpolation) or interpolation using a given function (nonlinear function). Note that, as will be described later using FIG. 9, the processing circuit 120 may perform frame rate control (hereinafter, referred to as FRC), and decimal gray levels (gray levels obtained by further finely dividing the 256 gray levels) can also be used as the output gray level.

FIG. 7 is a diagram for describing a correspondence relationship between set points in the present embodiment and the input gray levels and output gray levels at the respective set points. One row in FIG. 7 represents one set point. At a first set point, the input gray level is 0, and the output gray level is also 0. Also, at a second set point, the input gray level is gray level 8, and the output gray level is gray level 9. Therefore, the processing circuit 120 may perform processing, as the gamma conversion processing, in which gray level 0 is output if the display data is gray level 0, gray level 9 is output if the display data is gray level 8, and a gray level obtained by performing interpolation processing (input gray level×1.125, with a simple linear interpolation between two points) is output if the display data is any of gray levels 1 to 7. The same is applied to other input gray levels, and the processing circuit 120 performs processing, as the gamma conversion processing, in which an output gray level corresponding to the input gray level is selected or computed using the relationship shown in FIG. 7.

The correspondence between input gray levels and output gray levels is determined based on characteristics of an electro-optical panel, as described above, and a characteristic (V-T characteristic) of the electro-optical panel is known to change according to temperature. Therefore, although appropriate gamma correction can be performed at a given temperature using the correspondence information shown in FIG. 7, appropriate gamma correction cannot be performed at a different temperature using the correspondence information. Specifically, the gamma value does not sufficiently approach a desired value, and there is a risk that the color will be unnatural.

Therefore, the display driver 100 (processing circuit 120) sets a plurality of temperature ranges, and performs temperature compensation processing so as to change the output gray level when the temperature range to which the temperature belongs changes. Specifically, the memory 130 stores correspondence information in which the input gray level group and the output gray level group are associated with each other for each temperature range. The processing circuit 120 changes the correspondence information to be referred to in the gamma conversion processing according to the temperature range to which the temperature belongs.

FIG. 8 shows an example of correspondence information at a temperature range different from that in FIG. 7. In the example in FIG. 8 as well, the memory 130 stores correspondence information between first to $k^{th}$ input gray levels and first to $k^{th}$ output gray levels at first to $k^{th}$ (k=17) set points, respectively.

Note that two pieces of correspondence information (tables) have been described in FIGS. 7 and 8, but the memory 130 may store three or more pieces of correspondence information. For example, in the case where the electro-optical panel is a display panel that displays a color image using a plurality of color components, gamma correction processing and temperature compensation processing are performed for each color component. Also, three or more temperature ranges may be used in the temperature compensation processing. That is, the memory 130 stores pieces of correspondence information whose number is equal to the number obtained by multiplying the number of color components by the number of temperature ranges.

Figure 9:
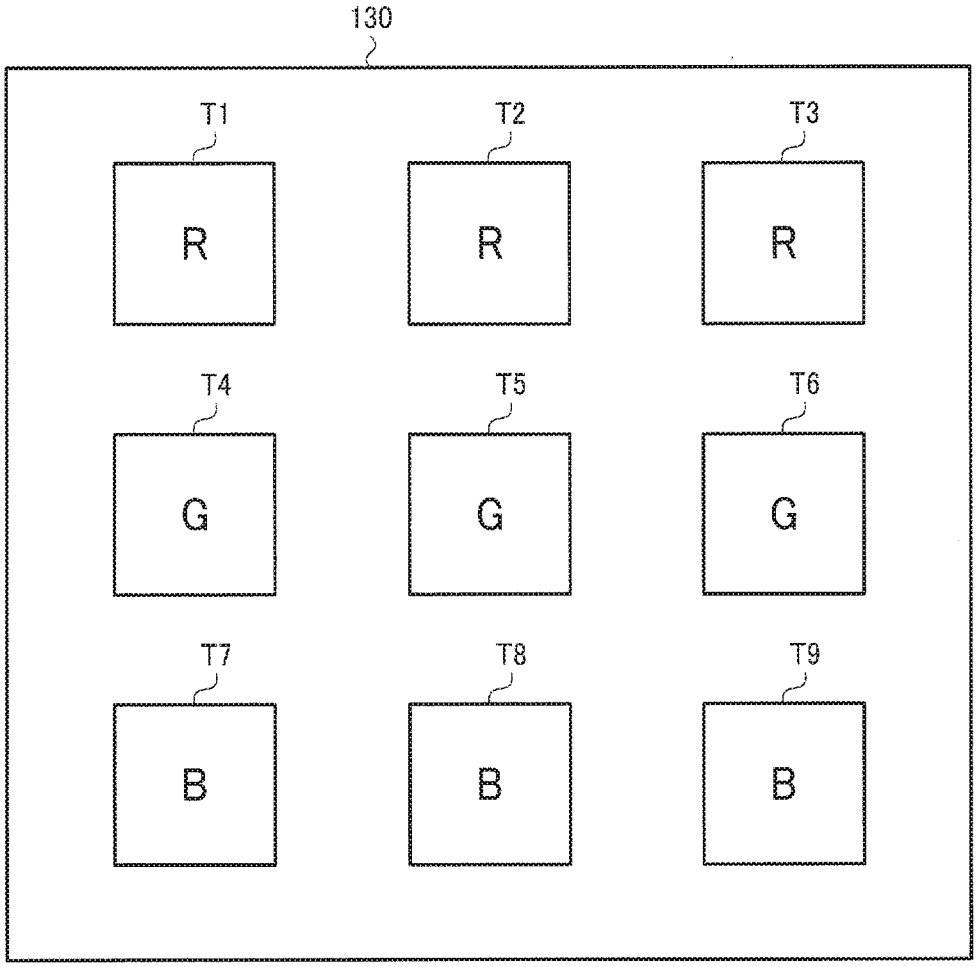
FIG. 9 is a diagram for describing correspondence information to be stored in a memory.

FIG. 9 is a diagram for describing correspondence information to be stored in the memory 130. T1 to T9 in FIG. 9 each indicates correspondence information (table), and T1 to T9 are each piece of information in which first to $k^{th}$ input gray levels and first to $k^{th}$ output gray levels at first to $k^{th}$ (k=17) set points are respectively associated with each other, as shown in FIGS. 7 and 8, for example.

In the example in FIG. 9, three R, G, and B components are used as the color components. Also, a case where three temperature ranges are used is shown in FIG. 9, and three pieces of correspondence information are stored for each of the R, G, and B components. The temperature ranges are three ranges, namely a low temperature of 0° C. or less, a normal temperature (medium temperature) from 0° C. to 50° C., and a high temperature of 50° C. or more, for example. When a given temperature is obtained, the processing circuit 120 specifies the temperature range to which the temperature belongs. For example, temperatures at −5° C., 25° C., and 70° C. are respectively determined to be in the low temperature range, the normal temperature range, and the high temperature range. Hereinafter, a description will be given assuming that T1, T4, and T7 are pieces of correspondence information in the low temperature range, T2, T5, and T8 are pieces of correspondence information in the normal temperature range, and T3, T6, and T9 are pieces of correspondence information in the high temperature range. Note that various modifications will be possible regarding the setting of the temperature ranges such as four or more temperature ranges being provided and the temperature at a boundary between temperature ranges being changed.

When the temperature range to which the temperature (temperature indicated by temperature information) detected by a temperature sensor belongs is changed from the normal temperature range to the low temperature range, the processing circuit 120 changes the correspondence information to be used in gamma conversion processing with respect to an R signal component from T2 to T1. Similarly, the processing circuit 120 changes the correspondence information to be used in gamma conversion processing with respect to a G signal component from T5 to T4, and changes the correspondence information to be used in gamma conversion processing with respect to a B signal component from T8 to T7. In this way, the processing circuit 120 changes, for each color component, the correspondence information to be referred to according to the temperature range to which the temperature detected by the temperature sensor belongs, and as a result, temperature compensation processing is realized.

FIG. 7 shows an example of the correspondence information of a given color component in a first temperature range, and FIG. 8 shows an example of the correspondence information of the same color component in a second temperature range. As is evident from the comparison between FIGS. 7 and 8, the output gray level changes depending on the temperature range even at a set point associated with the same input gray level. For example, the output gray level at a first set point is 9 in the example in FIG. 7, and is 12 in the example in FIG. 8.

The processing circuit 120 need only change the target value of the output gray level from the value in FIG. 7 to the value in FIG. 8 when the temperature range has changed from the first temperature range to the second temperature range. In the case of the display data (input gray level) being 8, for example, the processing circuit 120 realizes temperature compensation by changing the display data subjected to the gamma conversion processing from 9 to 12.

However, in the examples in FIGS. 7 and 8, there are set points at which the difference in output gray level is several tens of gray levels, and it is possible that, in terms of the drive voltage, the difference in voltage becomes a large voltage such as about 0.5 V. If the output gray level is changed rapidly in a short period of time, the change in luminance or color increases, and as a result, there is a risk that the change is recognized as flickering in a screen.

Accordingly, in the present embodiment, in the case where, at a first set point at which a first output gray level is associated with a first input gray level in gamma conversion processing, the first output gray level is gray level m when the temperature range is the first temperature range, and is gray level n (m and n are integers of zero or more and are different to each other) when the temperature range is the second temperature range, the processing circuit 120 changes the first output gray level from gray level m to gray level n by a step smaller than $|n-m|$ when the temperature range has transitioned from the first temperature range to the second temperature range.

In this way, the processing circuit 120 can change the output gray level from gray level m to gray level n over a plurality of stages. A rapid change in output gray level can be suppressed, and as a result, flickering or the like in a screen can be suppressed.

FIG. 10 shows an example of the output gray levels at a plurality of set points (P1 to P17) in the first temperature range and in the second temperature range. Hereinafter, in order to simplify the description, the temperature compensation processing (gamma conversion processing) of the present embodiment in the case where the temperature indicated by temperature information has transitioned from the first temperature range to the second temperature range will be described using the table in FIG. 10 in which the change in gray level between the temperature ranges is relatively small. Note that, as shown in FIGS. 7 and 8, the output gray levels in the temperature ranges are not limited to those shown in FIG. 10. Also, as shown in FIG. 9, the method of the present embodiment described in the following can be extended so as to include a plurality of color components or three or more temperature ranges.

Figure 11:
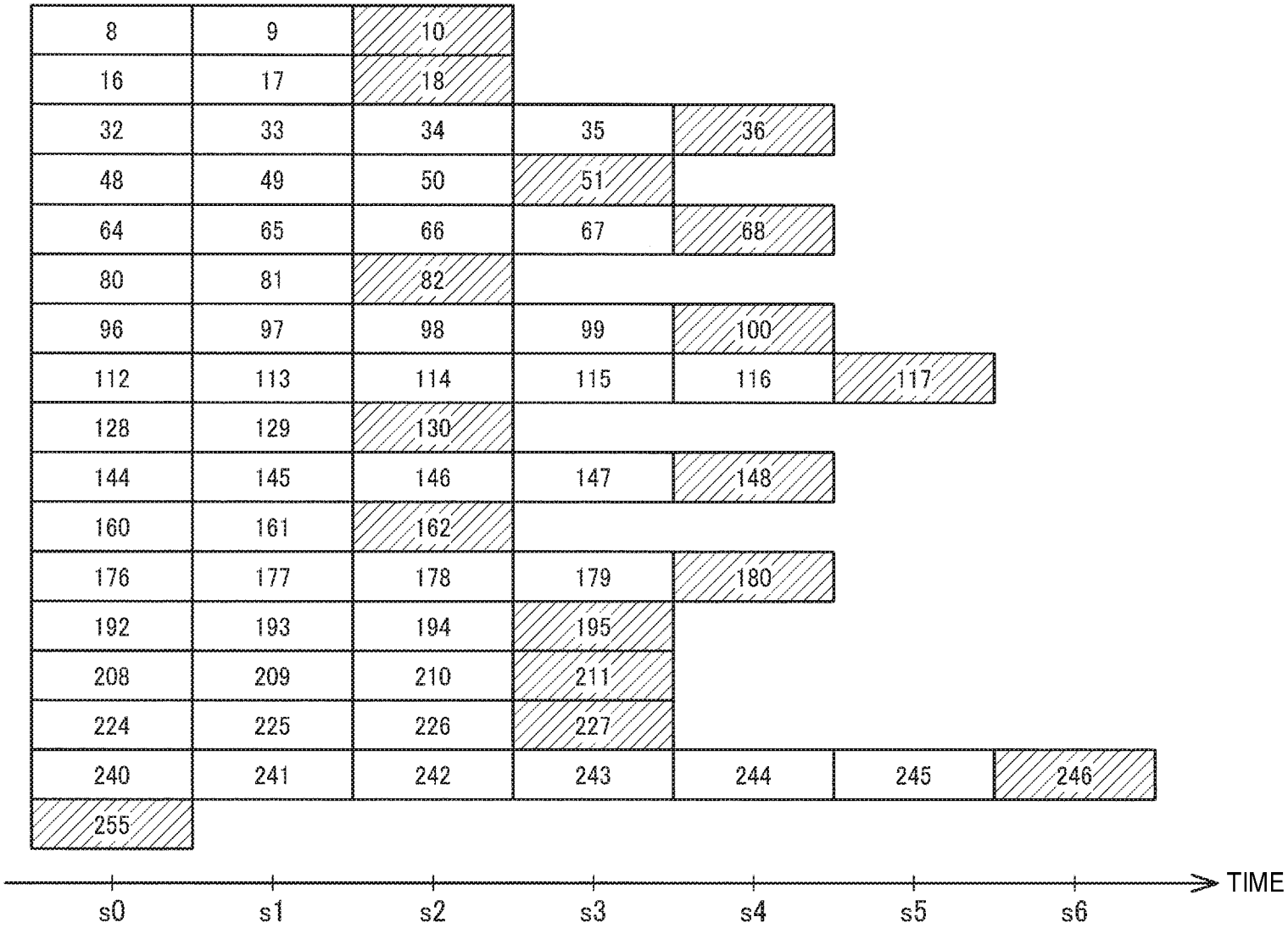
FIG. 11 shows an example of temporal changes in output gray level at respective set points.

FIG. 11 is a diagram for describing the change in output gray level at each set point, in the example in FIG. 10. One row in FIG. 11 is associated with one set point, and the rows from the top show the temporal changes in output gray level that are respectively associated with set points P1, P2, and P3, the lowest row being associated with a set point P17. A step in FIG. 11 is a period representing a unit time according to which the output gray level is changed, and the processing circuit 120 performs processing for changing the output gray level once per one step. s0 indicates a step before the change in output gray level starts (before the change starts), and s1 indicates the first timing of change in output gray level. One step in FIG. 11 is five seconds long, for example, but may be changeable as will be described later.

As shown in FIG. 11, when the temperature range has transitioned from the first temperature range to the second temperature range, the processing circuit 120 changes the first output gray level from gray level m to gray level n by predetermined gray levels per step. In the example in FIG. 11, the predetermined gray levels is one gray level. At the set point P1, the output gray level (gray level m) in the first temperature range is gray level 8, and the output gray level (gray level n) in the second temperature range is gray level 10. Accordingly, the processing circuit 120 changes the output gray level associated with the set point P1 to gray level 9 at s1, and to gray level 10 at s2. Note that, the "first set point" here may be one of points at each of which the input gray level and the output gray level are associated with each other by the correspondence information, and is not limited to the point (P1) on the lowest gray level side.

In this way, the processing circuit 120 can easily calculate the output gray level at each step. In the example in FIG. 11, the processing circuit 120 can determine the output gray level by incrementing the output gray level in the previous step. That is, the temperature compensation processing can be realized by simple control and a simple circuit configuration. With the method of the present embodiment, the gray level range and the color difference $\Delta E$ need not be considered as in the method in JP-A-2009-294265, and fine analog voltage control need not be realized as in the method in JP-2015-176120.

Also, as shown in FIG. 11, in the case where, at a second set point at which a second output gray level is associated with a second input gray level in gamma conversion processing, the second output gray level is gray level p when the temperature range is the first temperature range, and is gray level q (p and q are integers of zero or more and are different to each other) when the temperature range is the second temperature range, the processing circuit 120 changes the second output gray level from gray level p to gray level q by a step smaller than $|q-p|$ when the temperature range has transitioned from the first temperature range to the second temperature range.

In this way, temperature compensation processing in which flickering in a screen is suppressed can be realized with simple control and a simple circuit configuration, with the plurality of set points being the targets.

As shown in FIG. 11, when the temperature range has transitioned from the first temperature range to the second temperature range, the processing circuit 120 changes the second output gray level from gray level p to gray level q by predetermined gray levels per step. In the example in FIG. 11, the predetermined gray levels constitute one gray level. At the set point P2, the output gray level p in the first temperature range is gray level 16, and the output gray level q in the second temperature range is gray level 18. Accordingly, the processing circuit 120 changes the output gray level associated with the set point P2 to gray level 17 at s1, and to gray level 18 at s2. Note that the"second set point" here may be one of points, other than the above-described "first set point", at each of which the input gray level and the output gray level are associated with each other by the correspondence information, and is not limited to the point (P2) second from the low gray level side. Note that the predetermined gray levels, here, need not be fixed in all of the steps from the start to the end of gray level change. For example, the predetermined gray levels may be changed such that the output gray level is changed from gray level 5→gray level 4→gray level 2 (one gray level to two gray level in this example).

Also, in the case where an $i^{th}$ input gray level is associated with an $i^{th}$ output gray level at an $i^{th}$ (i is an integer that satisfies $3 \leq i \leq k$) set point of third to $k^{th}$ (k is an integer of three or more) set points in the gamma conversion processing, the $i^{th}$ output gray level is gray level x when the temperature range is the first temperature range, and the $i^{th}$ output gray level is gray level y (x and y are integers of zero or more and are different to each other) when the temperature range is the second temperature range, the processing circuit 120 may change the $i^{th}$ output gray level from gray level x to gray level y by a step smaller than $|y-x|$.

That is, with the method of the present embodiment, the output gray level can be changed step by step (by predetermined gray levels, in a narrow sense), with three or more set points being the targets. In this way, temperature compensation processing in which flickering in a screen is suppressed can be realized with a simple configuration, with various input gray levels being the targets. Specifically, the processing circuit 120 may change the output gray level step by step (by predetermined gray levels), with all of the set points being the target in the gamma conversion processing. In the example in FIG. 11, the processing circuit 120 changes the output gray level by one gray level per step with respect to set points P3 to P16 as well.

However, in the present embodiment, the output gray level need only be changed from gray level m to gray level n by a step smaller than $|n-m|$ at at least some set points of all of the set points (17 points in the example in FIG. 7 and the like), and at some set points, the output gray level may be changed by $|n-m|$ gray levels per step. Specifically, in the case where the difference in output gray level due to the change of temperature range is small, and there is a set point at which $|n-m|=1$, even if the output gray level is changed by one gray level, the output gray level at the set point is changed by $|n-m|$ gray levels per step. That is, the change in gray level may be $|n-m|$, depending on the value $|n-m|$ and the value of the "predetermined gray levels". Also, there may be a set point at which n=m, and a change in gray level does not occur, as P17 in FIG. 11. Furthermore, the set point at which n=m is not limited to a set point at a low gray level end (P1) or a set point at a high gray level end (P17), and may be a set point therebetween.

Note that, with the method of the present embodiment in which the output gray level is changed by predetermined gray levels, the number of steps it takes to reach the target output gray level (output gray level associated with the second temperature range) differs depending on the absolute value of difference ($|n-m|$, $|q-p|$, $|y-z|$) in output gray level. For example, the change in output gray level ends at s2 at the set points P1 and P2, and the change in output gray level (32→36) ends at s4 at the set point P3. Similarly, the change in output gray level (48→51) ends at s3 at set point P4, the change in output gray level (112→117) ends at s5 at set point P8, and the change in output gray level (240→246) ends at s6 at set point P16.

As shown in FIG. 11, the processing circuit 120 changes the first output gray level from gray level m to gray level n in a first period after transition of temperature range has been detected, and changes the second output gray level from gray level p to gray level q in a second period after transition of temperature range has been detected, and at least portions of the first period and the second period overlap.

Here, the first period represents a period from when the change in output gray level started until the change has ended at the first set point, the change being incurred by detection of transition of temperature range. If the first set point is P1 in FIG. 11, for example, the first period corresponds to a period from s0 to s2, and if the second set point is P2, the second period corresponds to a period from s0 to s2.

If $|n-m|>|q-p|$, as in the case where the first set point is assumed to be P3 and the second set point is assumed to be P1, the second period (s0 to s2) is included in the first period (s0 to s4). In other words, at least a portion of the first period and the second period being overlapped may refer to a relationship in which one period is included in the other period.

In this way, temperature compensation processing (gamma conversion processing) on pieces of input data of different gray levels can be performed such that processing periods overlap. In the method in JP-2015-176120, a plurality of gray level ranges are provided, and the temperature compensation processing is successively performed for each gray level range. Therefore, it is possible that a period will exist in which temperature compensation (change in output gray level) has been completed in a given gray level range, but temperature compensation processing is not performed in the adjacent gray level range. Therefore, in an image on which processing for smoothing the spatial change in pixel value such as anti-aliasing processing has been performed, a large change occurs in the luminance (jump in luminance occurs) in the vicinity of pixels whose pixel values are in boundaries of gray level ranges, and a user may feel something is amiss. In this regard, in the present embodiment, temperature compensation processing is parallelly performed on a plurality of gray levels (set points), and therefore the occurrence of a jump in luminance can be suppressed.

More specifically, the processing circuit 120 changes the $i^{th}$ output gray level from gray level x to gray level y by a step smaller than $|y-x|$ in an $i^{th}$ period after a point in time at which the transition of temperature range from the first temperature range to the second temperature range is detected, and at least portions of the first period, the second period, and the $i^{th}$ period may overlap.

In the example in FIG. 11, at set points P1 to P16, at least portions of periods in which output gray levels are caused to change (specifically, period corresponding to s0 to s2) overlap. In this way, the temperature compensation processing is parallelly performed on gray levels in a wider gray level range (entire gray level region, in a narrow sense), and therefore the occurrence of a jump in luminance can be suppressed.

As shown in FIG. 11, the first period, and the second period (and the $i^{th}$ period) may start at the same timing. In the example in FIG. 11, the change in output gray level has not started at s0 in any of the set points, and a first change occurs at s1. The start timing may be considered to be s1 at which a first change occurs, or may be considered to be s0, which is a step immediately therebefore. In any case, as a result of unifying the start timing, the changes in output gray level start at the same time in a wider gray level range, and the user can be kept from feeling that something is amiss with the luminance or color.

Figure 12:
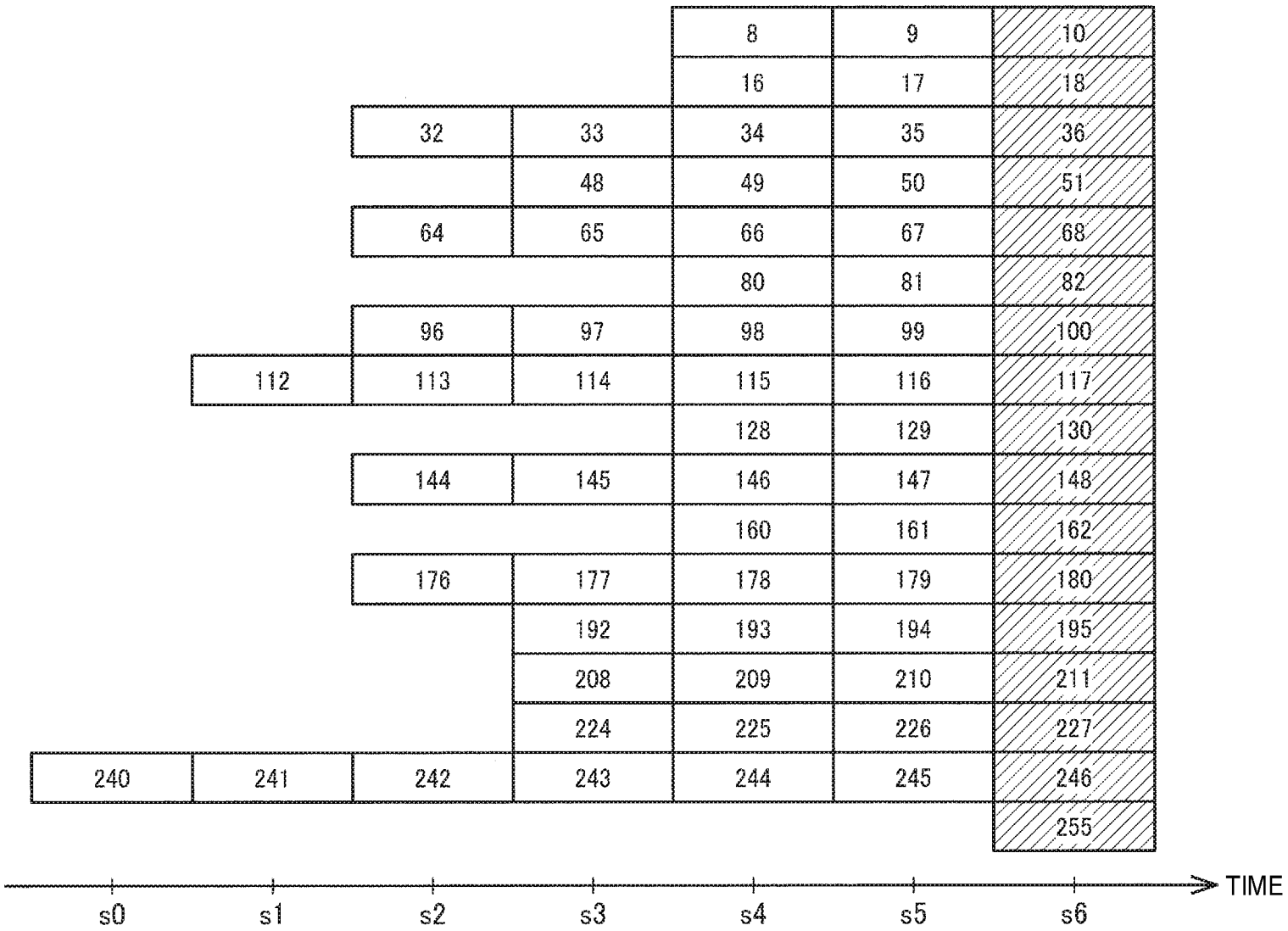
FIG. 12 shows another example of temporal changes in output gray level at respective set points.

FIG. 12 is another diagram for describing changes in output gray level at the respective set points, in the example in FIG. 10. In the example in FIG. 12, the start timing of change in output gray level is set for each set point such that the change in output gray level ends at step s6. At P1 or P2, the output gray level (8 or gray level 16) in the first temperature range is maintained until s4, and the change in output gray level starts from s5. At P3, the output gray level (gray level 32) in the first temperature range is maintained until s2, and the change in output gray level starts from s3. In this way, the first period and the second period (and the $i^{th}$ period) may end at the same timing. In this case as well, the output gray levels parallelly change in a wide gray level range, and therefore the user can be kept from feeling that something is amiss with the luminance or color.

Note that both the start timings and the end timings may each be the same in the set points, as in a later-described second embodiment. That is, at least a gray level of the start timings and the end timings are the same in the first period and the second period (and the $i^{th}$ period). Note that, from a viewpoint of suppressing feeling that something is amiss due to a jump in luminance or the like, it is sufficient that the first period and the second period have an overlapped period, and both the start timings and the end timings may each be different therebetween.

Figure 13:
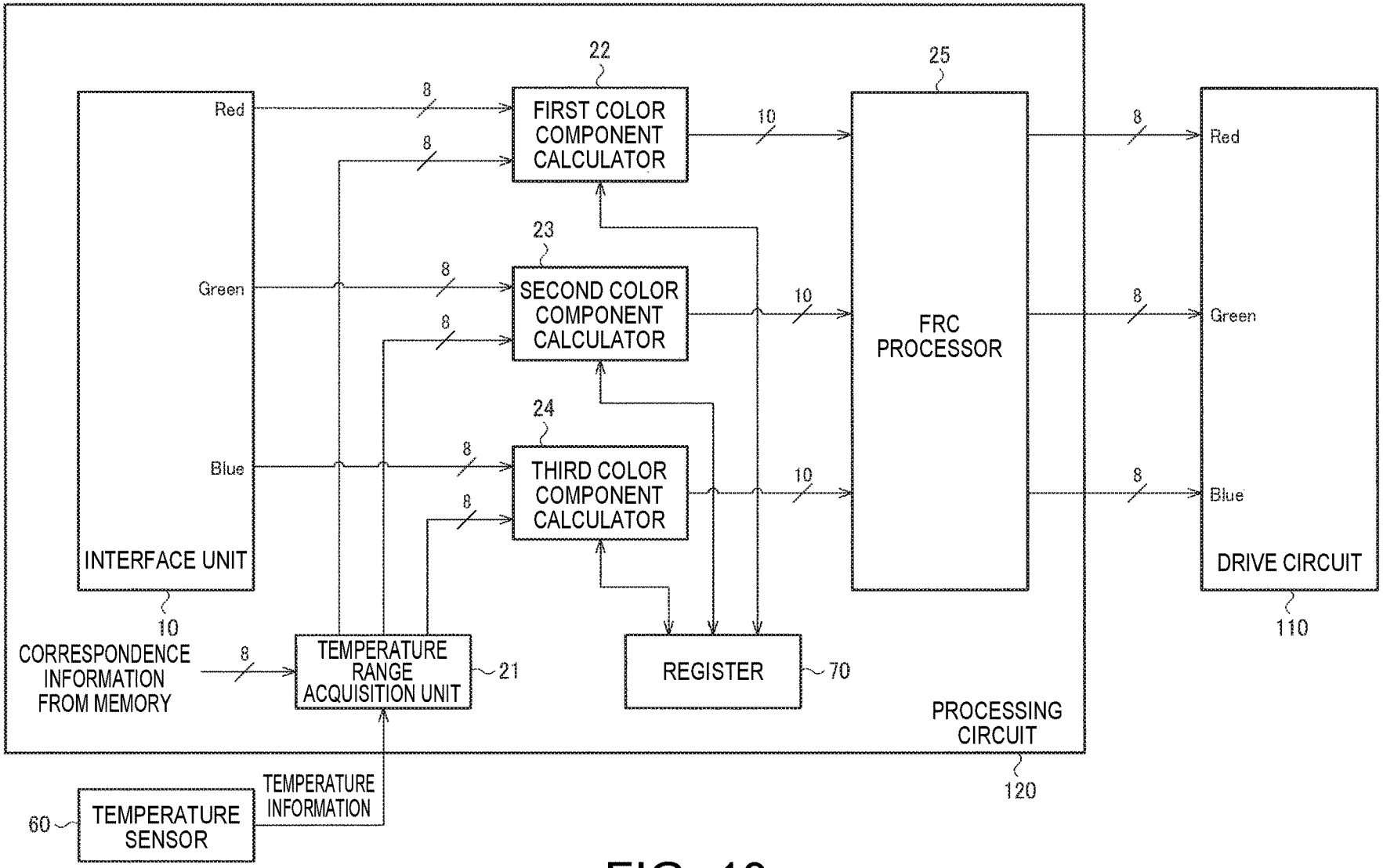
FIG. 13 shows a detailed exemplary configuration of a processing circuit.

FIG. 13 shows an exemplary configuration of the processing circuit 120 of the present embodiment. The processing circuit 120 includes a temperature range acquisition unit 21, a first color component calculator (first color component calculation circuit) 22, a second color component calculator (second color component calculation circuit) 23, a third color component calculator (third color component calculation circuit) 24, and an FRC processor (error diffusion circuit) 25. Note that the configuration of the processing circuit 120 is not limited to the configuration shown in FIG. 13, and various modifications are possible. Some of the constituent elements in FIG. 13 may be omitted, or other constituent elements may be added.

The temperature range acquisition unit 21 acquires information regarding a temperature range indicated by temperature information from a temperature sensor 60, and reads out information associated with the current temperature range from correspondence information (T1 to T9 in FIG. 9, for example) stored in the memory 130. For example, the display driver 100 of the present embodiment includes the temperature sensor 60, and the temperature range acquisition unit 21 may acquire the temperature information from the temperature sensor 60. In this case, the temperature range acquisition unit 21 performs processing for comparing the acquired temperature information with pre-set temperature ranges, and determines the temperature range to which the current temperature belongs. Alternatively, the temperature sensor 60 may be provided external to the display driver 100. In this case, the temperature range acquisition unit 21 acquires the temperature information from the external temperature sensor 60, and may determine the temperature range to which the current temperature belongs. Alternatively, processing for determining the temperature range to which temperature information belongs is performed in an external device, and the temperature range acquisition unit 21 may acquire the result of the processing.

Note that, here, first to third color components (R, G, and B) are envisioned to be used. Therefore, the memory 130 stores pieces of correspondence information for the respective color components, as shown in FIG. 9. The temperature range acquisition unit 21 reads out correspondence information of the first color component associated with the current temperature range, and reads out correspondence information of the second color component associated with the current temperature range, and reads out correspondence information of the third color component associated with the current temperature range.

The first color component calculator 22 acquires 8-bit data, which is first color component display data, that is externally input, and correspondence information (8-bit data representing output gray level, for example) associated with the first color component from the temperature range acquisition unit 21, and calculates a gray level value of the first color component. The processing to be performed in the first color component calculator 22 includes interpolation processing between set points and the above-described temperature compensation processing.

The first color component calculator 22 performs interpolation processing based on output gray levels at a plurality of (two, in a narrow sense) set points acquired from the temperature range acquisition unit 21, and calculates display data after gamma conversion processing, for example. The calculation, here, may include decimal data of 8-bit data, and the calculation result is expressed by data having a number of bits (10 bits, for example) larger than 8. That is, the first color component calculator 22 performs multi-level gray level processing based on input data, and may output multi-level gray level data (10-bit calculation result) to the FRC processor 25. Note that, if the gray level of the display data matches an input gray level associated with a set point, the interpolation processing may be omitted.

Also, when the transition of temperature range to which the temperature information belongs is detected by the determination performed by the temperature range acquisition unit 21, the first color component calculator 22 performs the temperature compensation processing. Specifically, the first color component calculator 22 sets a target value of the output gray level based on correspondence information in the new temperature range that has been transmitted from the temperature range acquisition unit 21. The target value, here, may be the output gray level itself at the set point, or may be the gray level obtained by performing the interpolation processing. Also, the first color component calculator 22 performs processing in which the output gray level is changed by predetermined gray levels (one gray level). Specifically, the first color component calculator 22 performs calculation (increment), at a given step, so as to increase the output gray level by one gray level from the previous step, and outputs the calculation result to the FRC processor 25. The first color component calculator 22 repeats the increment until the output gray level reaches the target value, and outputs the calculation result to the FRC processor 25.

The second color component calculator 23 and the third color component calculator 24 similarly perform calculation processing such as interpolation processing and temperature compensation processing on the respective pieces of color component display data, and output the calculation results to the FRC processor 25.

The FRC processor 25 performs frame rate control (FRC) with respect to multi-level gray level data, and outputs 8-bit data for each color to the drive circuit 110. In FRC, an intermediate gray level is realized by changing the gray level over a plurality of frames (four frames, for example). Note that various methods, other than FRC, for expressing the intermediate gray level are known, and these methods can be widely applied in the present embodiment. For example, spatial dithering processing may be performed to express the intermediate gray level.

Note that, as shown in FIG. 13, the display driver 100 of the present embodiment may include a register 70. The register 70 stores the above-described predetermined gray levels (width of change in output gray level in the temperature compensation processing). Alternatively, the register 70 stores a length of a period corresponding to one step.

In this way, information indicating the gray levels by which the output gray level is to be changed in the temperature compensation processing, or information indicating a period in which the output gray level is to be changed by one step (by predetermined gray levels) can be appropriately held. Also, the predetermined gray levels and the length of a period corresponding to one step may be variously set. In this way, the parameters used in the temperature compensation processing can be flexibly set. For example, the smaller the predetermined gray levels or the longer the period corresponding to one step, the smaller the change in output gray level in the temperature compensation processing and the longer the time it takes for the output gray level to reach a target value.

Note that the value of the predetermined gray levels was one gray level in the above-described embodiment, but may be two or more gray levels. Also, as was described relating to the FRC processor 25, the gray level in the present embodiment is not limited to an integer gray level. Decimal gray levels such as a half gray level and a quarter gray level can be set as the predetermined gray levels.

2. 2 Second Embodiment

FIG. 14 is another diagram for describing changes in output gray level at respective set points, in the example in FIG. 10.

As shown in FIG. 14, when the temperature range has transitioned from the first temperature range to the second temperature range, the processing circuit 120 changes the first output gray level from gray level m to gray level n, in a period corresponding to a predetermined number of steps s (s is an integer of two or more), by a gray level corresponding to $|n-m|/s$ gray levels per step, and changes the second output gray level from gray level p to gray level q, in the period corresponding to the predetermined number of steps s, by a gray level corresponding to $|q-p|/s$ gray levels per step.

In the example in FIG. 14, s=32, and the output gray level reaches an output gray level associated with the second temperature range at a 32nd step (s32) at all of the set points P1 to P16. Assume that the period corresponding to one step is one second, it takes 32 seconds to complete the change in output gray level at each set point.

At the set point P1, since the difference in output gray level between the first temperature range and the second temperature range is two, the change in gray level per step is $2/32=1/16$ gray levels. At the other set points as well, the change in gray level per step is $1/32$ of the difference in output gray level between the first temperature range and the second temperature range. The gray level may be a decimal gray level in the present embodiment, as described above. If a configuration is adopted in which $1/32$ gray levels can be expressed by the processing performed by the FRC processor 25, for example, each decimal gray level shown in FIG. 14 can be expressed.

According to the method of the present embodiment, the first period and the second period can be unified to have a length corresponding to s steps, as shown in FIG. 14. In other words, both the start timings and end timings of the first period and the second period can each be aligned. Also, the number of set points whose start timings and end timings each match is not limited to two, and may be three or more. In a narrow sense, as shown in FIG. 14, both the start timings and end timings may each be the same with respect to the periods in which output gray levels change at all of the set points (excluding a set point at which n=m, as P17).

In this way, the output gray levels can be parallelly changed, with a wider gray level range being the target. Furthermore, since the start timings and the end timings are each the same, the degree of progress in change until the respective target output gray levels can be aligned in all the gray levels. Therefore, the user can be further kept from feeling that something is amiss due to a jump in luminance compared with the first embodiment (FIGS. 11 and 12).

Note that the register 70 of the display driver 100 may store the predetermined number of steps s. In this way, the number of steps it takes for the output gray level to complete the change can be flexibly set. Note that, as a result of adjusting the length of a period corresponding to one step in addition thereto, the length of time it takes to complete the change in output gray level can be adjusted.

The first color component calculator 22 in FIG. 13, in the temperature compensation processing, reads out the predetermined number of steps s from the register 70, and obtains the amount of change in output gray level per step by dividing the absolute difference between an original output gray level (output gray level in the first temperature range) and a target value of the output gray level (output gray level in the second temperature range) by s. Also, the first color component calculator 22, at a given step, performs calculation to increase the output gray level from the previous step by the obtained change amount, and outputs the calculation result to the FRC processor 25. The first color component calculator 22 repeats the calculation to increase the output gray level until the output gray level reaches the target value (s steps), and output each calculation result to the FRC processor 25. Alternatively, the first color component calculator 22 may perform processing on data having a larger number of bits (11-bit data, for example) such as rounding down, rounding up, or rounding off based on the least significant bit, so as to calculate multi-level gray level data having a desired number of bits (10 bits, for example). In this way, as a result of performing processing according to the least significant bit, a gray level can be appropriately expressed using 10-bit data. The same applies to the second color component calculator 23 and the third color component calculator 24.

2. 3 Modifications

The display driver 100 includes a first memory that stores correspondence information between input gray levels and first temperature output gray levels, a second memory that stores correspondence information between the input gray levels and second temperature output gray levels, and the processing circuit 120 that reads out a first temperature output gray level from the first memory and outputs the read-out gray level when the temperature information detected by the temperature sensor is in the first temperature range, and reads out a second temperature output gray level from the second memory and outputs the read-out gray level when the temperature information is in the second temperature range. When the temperature information has transitioned from the first temperature range to the second temperature range, the processing circuit 120 outputs, after outputting an output gray level between the first temperature output gray level and the second temperature output gray level, the second temperature output gray level.

Focusing on an R component in the example in FIG. 9, the first memory corresponds to one of T1 to T3, and the second memory corresponds to one of the others. The same expansion can apply to a G component and a B component, and the first memory and the second memory may be different two of T4 to T6 for the G component and different two of T7 to T9 for the B component. Also, the first temperature output gray level indicates an output gray level associated with a given input gray level in the first memory, and the second temperature output gray level indicates an output gray level associated with the given input gray level in the second memory. In the case of P1 in FIG. 10, the first temperature output gray level is 8, and the second temperature output gray level is 10.

Also, the output gray level between the first temperature output gray level and the second temperature output gray level refers to a gray level whose gray level value is larger than the first temperature output gray level and smaller than the second temperature output gray level, or a gray level whose gray level value is smaller than the first temperature output gray level and larger than the second temperature output gray level. If the number of "output gray levels between the first temperature output gray level and the second temperature output gray level" is one, the processing circuit 120 changes the output gray level from the first temperature output gray level to the second temperature output gray level in two steps. As described above, the number of steps may be three or more, and there may be a plurality of "output gray levels between the first temperature output gray level and the second temperature output gray level".

Also, the temperature compensation processing has been described above in which the change in characteristics of an electro-optical panel due to a change in temperature is compensated for by changing the output gray level in the gamma conversion processing. However, the method of the present embodiment is not limited to the temperature compensation, and can be extended to processing in which the change in characteristics due to another environmental change is compensated.

The method of the present embodiment can be applied to a display driver 100 including a processing circuit 120 to which information regarding an environment range to which environmental information detected by an environmental sensor belongs is input and performs gray level gamma conversion processing on display data. In the case where, at a first set point at which a first output gray level is associated with a first input gray level in gamma conversion processing, the first output gray level is gray level m when the environment range is the first environment range, and is gray level n (m and n are integers of zero or more and are different to each other) when the environment range is the second environment range, the processing circuit 120 changes the first output gray level from gray level m to gray level n by a step smaller than $|n-m|$ when the environment range has transitioned from the first environment range to the second environment range.

In this way, in the case where the characteristics in an electro-optical panel change due to a change in environment other than temperature, the change in the characteristics can be compensated for by adjusting the output gray level through gamma conversion processing performed in the processing circuit 120. In this case, as described above, the output gray level is to be changed step by step in order to compensate for the environmental change, such as being changed by predetermined gray levels (first embodiment) or being changed over a period corresponding to a predetermined number of steps s (second embodiment). Accordingly, while using a simple circuit configuration, the rapid change in luminance that occurs when an environmental change is compensated for can be suppressed.

The environmental information, here, may be optical information or temporal information. The optical information is information indicating brightness around the display driver 100 (electro-optical panel, electro-optical device), and is illuminance information acquired from an illuminance sensor, for example. In this case, the environment range refers to a brightness range, and includes a range in which the illuminance is relatively high (bright) and a range in which the illuminance is relatively low (dark). Note that, similarly to the temperature range, the number of brightness ranges may be three or more.

In the case of using optical information as the environmental information, the luminance of the electro-optical panel can be adjusted according to the brightness around the display driver 100. For example, when the illuminance in the surrounding environment is determined to be low (dark) based on the current illuminance information, the processing circuit 120 reduces the luminance of the electro-optical panel relative to the case where the illuminance in the surrounding environment is high (bright), so as to increase the visibility of an image by a user. In the case of a normally black electro-optical panel, when the surrounding environment is dark, the processing circuit 120 performs control such that the drive circuit 110 applies a relatively low voltage as the drive voltage. The normally black electro-optical panel is a display panel in which transmittance or reflectance is minimum when a voltage is not applied, and black is displayed, for example. In the case of using a normally white electro-optical panel, when the surrounding environment is dark, the processing circuit 120 performs control such that the drive circuit 110 applies a relatively high voltage as the drive voltage.

Also, the temporal information refers to information representing an operation time of an electro-optical panel. The temporal information, here, may be information regarding a period of time from when the power of the electro-optical panel is turned on, and that is reset to 0 when the power of the electro-optical panel is turned off. Alternatively, the temporal information may be information indicating a cumulative operation time from when the electro-optical panel has been manufactured, which is not reset when the power is turned off. In this case, the environment range represents a time range, and includes a range in which the operation time is less than or equal to a predetermined time, and a range in which the operation time is longer than the predetermined time, for example. Of course, the number of time ranges may be three or more.

When the temporal information is used as the environmental information, the processing circuit 120 can appropriately perform processing for compensating for the change over time, in an electro-optical panel, due to an increase in continuous operation time or cumulative operation time of the electro-optical panel.

3. Display Controller, Electro-optical Device, and Electronic Apparatus

An example in which the display driver 100 includes the processing circuit 120 that performs data processing on the display data and timing control has been described above. This example corresponds to an example in which the display controller 300 is incorporated in the display driver 100. Note that the application of the method of the present embodiment is not limited to this, and the method can be applied to the above-described display controller 300 that performs the gamma conversion processing.

The display controller 300 includes the processing circuit 120 to which information regarding the temperature range to which temperature information detected by the temperature sensor 60 belongs is input, and that performs gray level gamma conversion processing on display data. In the case where, at a first set point at which a first output gray level is associated with a first input gray level in gamma conversion processing, the first output gray level is gray level m when the temperature range is the first temperature range, and is gray level n (m and n are integers of zero or more and are different to each other) when the temperature range is the second temperature range, the processing circuit 120 changes the first output gray level from gray level m to gray level n by a step smaller than $|n-m|$ when the temperature range has transitioned from the first temperature range to the second temperature range.

In this way, a display controller 300 in which a rapid change in luminance and color due to temperature compensation processing can be suppressed can be realized with a simple configuration.

Also, the method of the present embodiment can be applied to an electro-optical device 350 including the above-described display driver 100 and an electro-optical panel 200. Alternatively, the method of the present embodiment can be applied to an electronic apparatus including the above-described display driver 100 or display controller 300.

Figure 15:
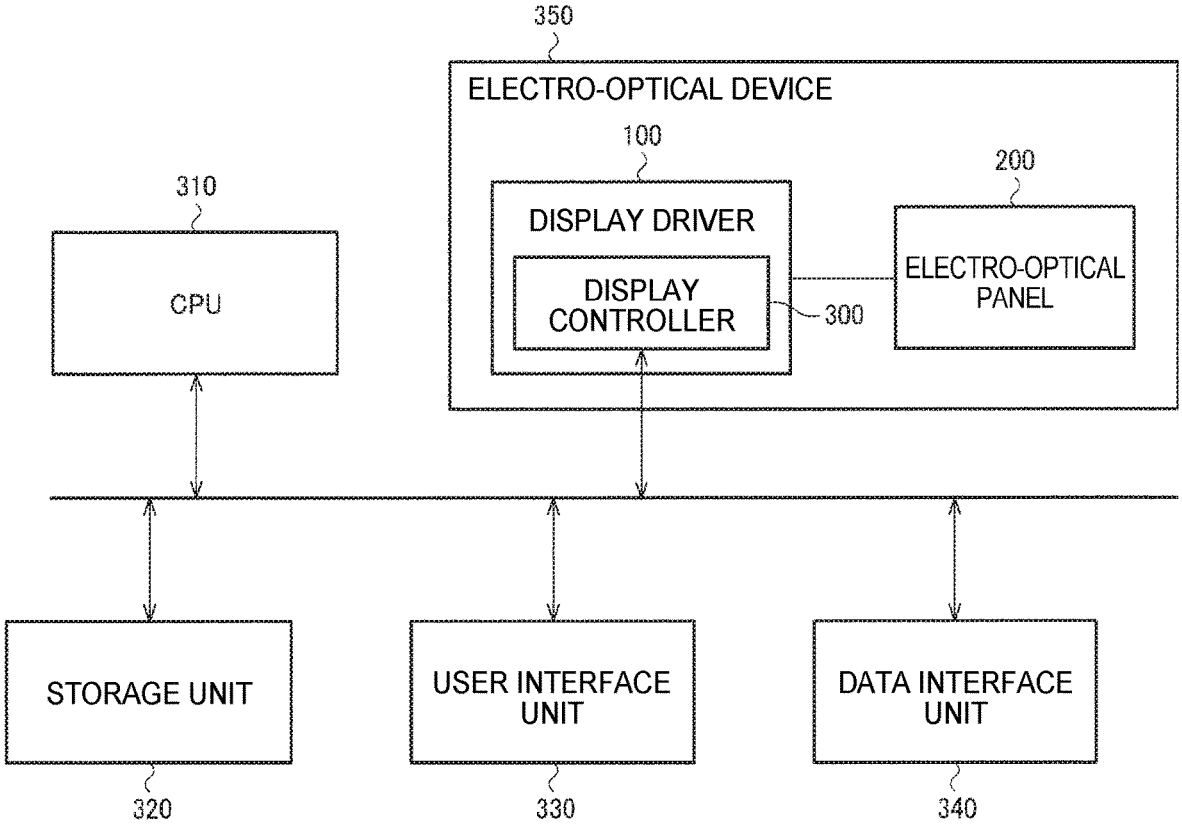
FIG. 15 shows an exemplary configuration of an electronic apparatus and an electro-optical device.
Figure 16:
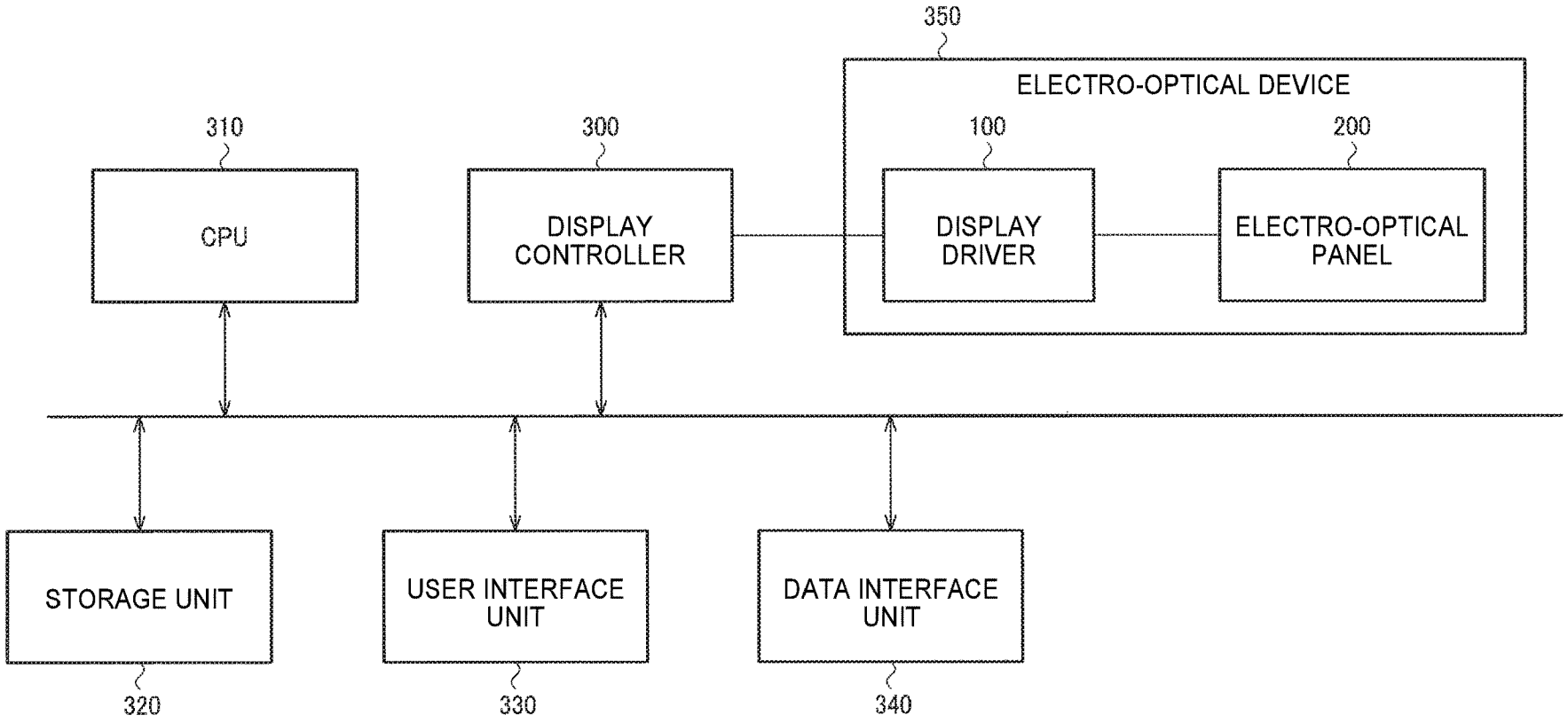
FIG. 16 shows an exemplary configuration of an electronic apparatus and an electro-optical device.

Exemplary configurations of an electro-optical device and an electronic apparatus to which the method of the present embodiment can be applied are shown in FIGS. 15 and 16. As shown in FIG. 15, the display driver 100 of the present embodiment may be configured to include the display controller 300, or the display driver 100 and the display controller 300 may be separately provided, as shown in FIG. 16. Hereinafter, an example in FIG. 16 will be described.

Various electronic apparatuses, on which a display device is mounted, such as an on-board display device (such as a meter panel, for example), a monitor, a display, a single-panel projector, a television device, an information processing device (computer), a mobile information terminal, a car navigation system, a mobile game terminal, a DLP (Digital Light Processing) device, and a printer, for example, can be envisioned as an electronic apparatus including the display driver 100 or the display controller 300 according to the present embodiment.

An electronic apparatus shown in FIG. 16 includes an electro-optical device 350, a CPU 310 (a processing device, in a broad sense), a display controller 300 (host controller), a storage unit 320, a user interface unit 330, and a data interface unit 340. The electro-optical device 350 includes a display driver 100 and an electro-optical panel 200.

The electro-optical panel 200 is a matrix type liquid crystal display panel, for example. Alternatively, the electro-optical panel 200 may be an EL (Electro-Luminescence) display panel using a self-luminous element. For example, the electro-optical panel 200 may be a display panel (organic EL display) using an organic light-emitting diode (OLED). For example, the electro-optical panel 200 is formed on a glass substrate, and the display driver 100 is mounted on the glass substrate. The electro-optical device 350 is configured as a module including the electro-optical panel 200 and the display driver 100 (the electro-optical device 350 may further include the display controller 300). Note that the display controller 300 and the display driver 100 may be incorporated in the electronic apparatus as separate components instead of being configured as a module.

The user interface unit 330 is an interface unit for accepting various operations from a user. The user interface unit 330 is constituted by a button, a mouse, a keyboard, a touch panel installed in the electro-optical panel 200, or the like, for example. The data interface unit 340 is an interface unit that performs receiving and outputting of display data and control data. The data interface unit 340 is a wired communication interface such as a USB, or a wireless communication interface such as a wireless LAN, for example. The storage unit 320 stores display data that is input from the data interface unit 340. Alternatively, the storage unit 320 functions as a work memory for the CPU 310 and the display controller 300. The CPU 310 performs control processing on the units of the electronic apparatus and various data processing. The display controller 300 performs control processing on the display driver 100. For example, the display controller 300 converts the display data transmitted from the data interface unit 340 or the storage unit 320 via the CPU 310 to a format acceptable to the display driver 100, and outputs the converted display data to the display driver 100. The display driver 100 drives the electro-optical panel 200 based on the display data transmitted from the display controller 300.

Note that, although the present embodiment has been described above in detail, those skilled in the art will easily understand that various modifications are possible without substantially departing from the new matter and the effect of the invention. Accordingly, all those modifications are to be encompassed in the scope of the invention. For example, a term that is used at least once together with another term having a broader or the same meaning in the specification or the drawings may be replaced with another term in any part of the specification or the drawings. Configurations, operations, or the like of the display driver, the display controller, the electro-optical device, and the electronic apparatus are not limited to those described in the present embodiment either, and may be modified in various manners.

This application claims priority from Japanese Patent Application No. 2017-148106 filed in the Japanese Patent Office on Jul. 31, 2017, the entire disclosure of which is hereby incorporated by reference in its entirely.

What is claimed is:

1. A display driver comprising:

a processing circuit to which information regarding a temperature range to which temperature information detected by a temperature sensor is input and that is configured to perform gamma conversion processing on display data with respect to gray level, wherein, in the gamma conversion processing, at a first set point at which a first input gray level is associated with a first output gray level, the first output gray level is gray level m when the temperature range is a first temperature range, and the first output gray level is gray level n (m and n are integers of zero or more and are different to each other) when the temperature range is a second temperature range, and the processing circuit is configured to, when the temperature range has transitioned from the first temperature range to the second temperature range, change the first output gray level from the gray level m to the gray level n by a step smaller than |n−m|, wherein in the gamma conversion processing, at a second set point at which a second input gray level is associated with a second output gray level, the second output gray level is gray level p when the temperature range is the first temperature range, and the first output gray level is gray level q (p and q are integers of zero or more and are different to each other) when the temperature range is the second temperature range, and the processing circuit is configured to, when the temperature range has transitioned from the first temperature range to the second temperature range, change the second output gray level from the gray level p to the gray level q by a step smaller than |q−p|, wherein the processing circuit is configured to cause the first output gray level to change from the gray level m to the gray level n in a first period after a transition in the temperature range has been detected, and cause the second output gray level to change from the gray level p to gray level q in a second period after the transition in temperature range has been detected, and at least portions of the first period and the second period overlap, wherein at an $i^{th}$ set point of third to $k^{th}$ set points (k is an integer of three or more, i is an integer that satisfies $3 \leq i \leq k$) in the gamma conversion processing, an $i^{th}$ input gray level is associated with an $i^{th}$ output gray level, the $i^{th}$ output gray level is gray level x when the temperature range is the first temperature range, and the $i^{th}$ output gray level is gray level y (x and y are integers of zero or more and are different to each other) when the temperature range is the second temperature range, the processing circuit is configured to, in an $i^{th}$ period after the temperature range has transitioned from the first temperature range to the second temperature range, change the $i^{th}$ output gray level from the gray level x to the gray level y by a step smaller than |y−x|, and at least portions of the first period, the second period, and the $i^{th}$ period overlap, and wherein the processing circuit is configured to obtain an output gray level associated with an input gray level between the $i^{th}$ set point and an $i+1^{th}$ set point by performing interpolation processing based on the $i^{th}$ output gray level and an $i+1^{th}$ output gray level at the $i+1^{th}$ set point.

2. The display driver according to claim 1, wherein the processing circuit is configured to, when the temperature range has transitioned from the first temperature range to the second temperature range, cause the first output gray level to change from the gray level m to the gray level n, in a period corresponding to a predetermined number of steps s (s is an integer of two or more), by |n−m|/s gray levels per step, and cause the second output gray level to change, in the period corresponding to the predetermined number of steps s, by |q−p|/s gray levels per step.

3. The display driver according to claim 2, further comprising a register for storing the predetermined number of steps s.

4. The display driver according to claim 2, wherein the register stores a length of a period corresponding to one step.

5. The display driver according to claim 1, wherein the processing circuit is configured to, when the temperature range has transitioned from the first temperature range to the second temperature range, cause the first output gray level to change from the gray level m to the gray level n by predetermined gray levels per step, and cause the second output gray level to change from the gray level p to the gray level q by the predetermined gray levels per step.

6. The display driver according to claim 5, further comprising a register for storing the predetermined gray levels.

7. The display driver according to claim 1, wherein start timings of the first period and the second period and end timings of the first period and the second period are the same.

8. The display driver according to claim 1, further comprising a memory for storing correspondence information between first to $k^{th}$ input gray levels (k is an integer of two or more) and first to $k^{th}$ output gray levels at first to $k^{th}$ set points, respectively.

9. An electro-optical device comprising:

the display driver according to claim 1; and an electro-optical panel.

10. An electronic apparatus comprising:

a central processing unit (CPU); and the display driver according to claim 1.

11. A display driver comprising:

a processing circuit to which information regarding an environment range to which environmental information detected by an environmental sensor belongs is input, and that is configured to perform gamma conversion processing on display data with respect to gray level, wherein, in the gamma conversion processing, at a first set point at which a first input gray level is associated with a first output gray level, the first output gray level is gray level m when the environment range is a first environment range, and the first output gray level is gray level n (m and n are integers of zero or more and are different to each other) when the environment range is a second environment range, and the processing circuit is configured to, when the environment range has transitioned from the first environment range to the second environment range, change the first output gray level from the gray level m to the gray level n by a step smaller than |n−m|, wherein in the gamma conversion processing, at a second set point at which a second input gray level is associated with a second output gray level, the second output gray level is gray level p when the environment range is the first environment range, and the first output gray level is gray level q (p and q are integers of zero or more and are different to each other) when the environment range is the second environment range, and the processing circuit is configured to, when the environment range has transitioned from the first environment range to the second environment range, change the second output gray level from the gray level p to the gray level q by a step smaller than |q−p|, wherein the processing circuit is configured to cause the first output gray level to change from the gray level m to the gray level n in a first period after a transition in the environment range has been detected, and cause the second output gray level to change from the gray level p to gray level q in a second period after the transition in environment range has been detected, and at least portions of the first period and the second period overlap, wherein at an $i^{th}$ set point of third to $k^{th}$ set points (k is an integer of three or more, i is an integer that satisfies $3 \leq i \leq k$) in the gamma conversion processing, an $i^{th}$ input gray level is associated with an $i^{th}$ output gray level, the $i^{th}$ output gray level is gray level x when the environment range is the first environment range, and the $i^{th}$ output gray level is gray level y (x and y are integers of zero or more and are different to each other) when the environment range is the second environment range, the processing circuit is configured to, in an $i^{th}$ period after the environment range has transitioned from the first environment range to the second environment range, change the $i^{th}$ output gray level from the gray level x to the gray level y by a step smaller than $|y-x|$, and at least portions of the first period, the second period, and the $i^{th}$ period overlap, and wherein the processing circuit is configured to obtain an output gray level associated with an input gray level between the $i^{th}$ set point and an $i+1^{th}$ set point by performing interpolation processing based on the $i^{th}$ output gray level and an $i+1^{th}$ output gray level at the $i+1^{th}$ set point.

12. The display driver according to claim 11, wherein the environmental information is optical information or temporal information.

* * * * *